US012173563B2

(12) United States Patent
Becker

(10) Patent No.: US 12,173,563 B2
(45) **Date of Patent: *Dec. 24, 2024**

(54) TUBING SYSTEM FOR WELL OPERATIONS

(71) Applicant: DUCON—BECKER SERVICE TECHNOLOGY, LLC., Ventura, CA (US)

(72) Inventor: Billy G. Becker, Ventura, CA (US)

(73) Assignee: DUCON-BECKER SERVICE TECHNOLOGY, LLC, Ventura, CA (US)

( * ) Notice: Subject to any disclaimer, the term of this patent is extended or adjusted under 35 U.S.C. 154(b) by 110 days.

This patent is subject to a terminal disclaimer.

(21) Appl. No.: 17/428,300

(22) PCT Filed: Oct. 3, 2019

(86) PCT No.: PCT/US2019/054387

§ 371 (c)(1),
(2) Date: Aug. 4, 2021

(87) PCT Pub. No.: WO2020/162986

PCT Pub. Date: Aug. 13, 2020

(65) Prior Publication Data

US 2022/0120144 A1 Apr. 21, 2022

Related U.S. Application Data

(60) Provisional application No. 62/801,396, filed on Feb. 5, 2019.

(51) Int. Cl.
*E21B 17/042* (2006.01)
*E21B 19/16* (2006.01)

(52) U.S. Cl.
CPC ..... *E21B 17/042* (2013.01); *E21B 19/16* (2013.01)

(58) Field of Classification Search
CPC ..... E21B 17/042; E21B 19/16
See application file for complete search history.

(56) References Cited

U.S. PATENT DOCUMENTS 3,065,807 A 11/1962 Wells
3,216,512 A 11/1965 Grable
3,489,438 A 1/1970 Mcclure
(Continued)

OTHER PUBLICATIONS

International Search Report / Written Opinion in related/corresponding PCT Application No. PCT/US2019/054387 dated Feb. 4, 2020.

(Continued)

*Primary Examiner* — Taras P Bemko
(74) *Attorney, Agent, or Firm* — Morgan, Lewis & Bockius LLP

(57) ABSTRACT

A joint pipe element for transporting a fluid in a well includes an outer pipe having first threads at a first end; an inner pipe having first threads at a first end, the inner pipe being located inside the outer pipe; and plural lugs located between the outer pipe and the inner pipe. The first threads of the first end of the outer pipe and the first threads of the first end of the inner pipe have the same number of teeth per unit length so that the outer pipe and the inner pipe are connected, simultaneously, by a single rotational motion, to another joint pipe element.

12 Claims, 39 Drawing Sheets

(56) References Cited

U.S. PATENT DOCUMENTS

| | | | | |
|---|---|---|---|---|
| 3,664,441 | A * | 5/1972 | Carey | E21B 17/04 175/215 |
| 3,786,878 | A * | 1/1974 | Chapman | F16L 39/005 175/215 |
| 3,943,618 | A * | 3/1976 | Perkins | E21B 17/00 29/445 |
| 4,067,596 | A | 1/1978 | Kellner et al. | |
| 4,100,981 | A * | 7/1978 | Chaffin | E21B 21/12 175/215 |
| 4,149,739 | A | 4/1979 | Morris | |
| 4,997,048 | A | 3/1991 | Isom | |
| 5,139,090 | A | 8/1992 | Land | |
| 5,775,736 | A | 7/1998 | Svetlik | |
| 5,806,598 | A | 9/1998 | Amani | |
| 5,911,278 | A | 6/1999 | Reitz | |
| 6,305,476 | B1 | 10/2001 | Knight | |
| 7,134,514 | B2 | 11/2006 | Riel et al. | |
| 8,539,976 | B1 | 9/2013 | Rodgers, Jr. et al. | |
| 8,777,273 | B2 | 7/2014 | Syse et al. | |
| 10,718,457 | B2 | 7/2020 | Haynes et al. | |
| 2001/0048854 | A1* | 12/2001 | Carter, Jr. | E02D 5/46 52/742.16 |
| 2003/0164240 | A1 | 9/2003 | Vinegar et al. | |
| 2004/0182437 | A1 | 9/2004 | Messick | |
| 2005/0061369 | A1 | 3/2005 | De Almeida | |
| 2006/0283606 | A1 | 12/2006 | Partouche et al. | |
| 2007/0227739 | A1 | 10/2007 | Becker et al. | |
| 2007/0235197 | A1 | 10/2007 | Becker et al. | |
| 2011/0067883 | A1 | 3/2011 | Falk et al. | |
| 2011/0259597 | A1 | 10/2011 | Bjerke | |
| 2014/0041863 | A1 | 2/2014 | Dowling et al. | |
| 2014/0116725 | A1 | 5/2014 | Wollmann | |
| 2014/0179448 | A1 | 6/2014 | Collins et al. | |
| 2014/0284065 | A1 | 9/2014 | Fraignac et al. | |
| 2015/0315869 | A1 | 11/2015 | Landry | |
| 2017/0370162 | A1 | 12/2017 | Carrois et al. | |
| 2018/0320492 | A1 | 11/2018 | Shen et al. | |
| 2019/0376369 | A1 | 12/2019 | Daniel et al. | |
| 2020/0318452 | A1* | 10/2020 | Becker | E21B 17/042 |

OTHER PUBLICATIONS

International Preliminary Report on Patentability, PCT/US2019/054387, dated Aug. 10, 2021.

International Search Report and Written Opinion dated Jun. 22, 2020, in related/corresponding PCT Application No. PCT/US2020/024247.

International Preliminary Report on Patentability, PCT/US2020/024247, dated Sep. 28, 2021.

International Search Report and Written Opinion dated Jun. 22, 2020, in related/corresponding PCT Application No. PCT/US2020/024230.

International Preliminary Report on Patentability, PCT/US2020/024230, dated Sep. 28, 2021.

* cited by examiner

TUBING SYSTEM FOR WELL OPERATIONS

BACKGROUND

Technical Field

Embodiments of the subject matter disclosed herein generally relate to downhole tools for oil/gas exploration, and more specifically, to a tubing system that has inner and outer pipes coupled to each other to form plural single units (called herein joint pipe elements) and the joint pipe elements can be attached to each other to be used for well operations.

Discussion of the Background

After a well is drilled to a desired depth (H) relative to the surface, and a casing protecting the wellbore has been installed in the well, cemented in place, and perforated for connecting the wellbore to the subterranean formation, it is time to extract the oil and/or gas. At the beginning of the well's life, the pressure of the oil and/or gas from the subterranean formation is high enough so that the oil flows out of the well to the surface, unassisted, through the casing. Thus, for this stage of the well, no pressure assistance is typically needed to bring the oil to the surface.

However, the fluid pressure of the subterranean formation decreases over time to such a level that the hydrostatic pressure of the column of fluid in the well becomes equal to the formation pressure inside the subterranean formation. In this case, an artificial lift method (i.e., pump method) needs to be used to recover the oil and/or gas from the well. Thus, artificial lift is necessary for this life stage of the well to maximize recovery of the oil/gas.

There are many ways to assist the fluid (oil and/or gas) inside the well for being brought to the surface. One such method is the gas lift, which is typically characterized by having a production tubing, which is installed inside the production casing, strung into a downhole packer. The gas lift method is able to work in both low and high fluid rate applications and works across a wide range of well depths. The external energy introduced to the system for lifting the oil and/or gas is typically added by a gas compressor driven by a natural gas fueled engine. There can be single or multiple injection ports used along the vertical profile of the tubing string for the high-pressure gas lift gas to enter the production tubing. Multiple injection ports reduce the gas lift gas pressure required to start production from an idle well, but introduces multiple potential leak points that impact reliability. Single injection ports (including lifting around open-ended production tubing) are simpler and more reliable, but require higher lift gas pressures to start production from an idle well.

The gas lift method works by having the injected lift gas mixing with the reservoir fluids inside the production tubing and reducing the effective density of the fluid column. Gas expansion of the lift gas also plays an important role in keeping the flow rates above the critical flow velocities to push the fluids to the surface. For this method, the reservoir must have sufficient remaining energy to flow oil and gas into the inside of the production tubing and overcome the gas lift pressures being created inside the production tubing. The ultimate abandonment pressure associated with conventional gas lift methods and apparatus is materially higher than other methods such as rod or beam pumping.

Another method for pumping the fluid from inside the well to the surface is the Rod or Beam pumping, which typically produces the lowest abandonment pressure of any artificial lift method and ends up being the "end of life" choice to produce an oil well through to its economic limit. Rod pumping is characterized by the installation of production tubing, sucker rods and a downhole pump. Rod or Beam Pumping works in low to medium rate applications and from shallow to intermediate well depths. The downhole pump is typically installed in the well at a depth where the inclination from vertical is no greater than typically 15 degrees per 100' of vertical change, thus, limiting the pump intake to being no deeper than the curve in the heel to the horizontal well. The Rod or Beam Pumping in a deviated section typically has high rates of mechanical failures that creates higher operating expenses and more production downtime. The external energy introduced to the system is typically added through the use of a prime mover driving a gearbox on the "pumping unit." The prime mover can be an electrically driven motor or a natural gas fueled engine.

Another lifting process uses an Electrical Submersible Pump (ESP) to pump the fluid from the well. This process is characterized by the installation of centrifugal downhole pumps and downhole motors that are electrically connected back to the surface with shielded power cables to deliver the high voltage/amps necessary to operate. ESPs work in medium to high rate applications and from shallow depths to deep well depths. ESPs can be very efficient in a high rate application, but are expensive to operate and extremely expensive to recover and repair when they fail. Failure rates are typically higher for ESPs relative to other artificial lift methods. ESPs do not tolerate solids well so being used in a horizontal well that has been fracture stimulated with sand proppant introduces a likely failure mechanism. ESPs are also not very tolerant of pumping reservoir fluids with a high gas fraction. ESPs are typically only run into the curve/heel of a horizontal well.

Another lifting process uses Hydraulic Jet Pumps (HJPs), which are characterized by the installation of a production tubing, a downhole packer, a jet pump landing sub, and jet pump. Surface facilities associated with a HJP application require a separator and a high pressure multiplex pump. The system creates a pressure drop at the intake of the jet pump (Venturi effect) by circulating high pressure power fluids (oil or water) down the inside of the production tubing. Wellbore fluids and power fluids are then recovered at the surface by flowing up the annulus between the production casing and production tubing. The external energy introduced to the system is typically added through an electrical connection providing high voltage/amps. Some systems can use a natural gas driven prime mover connected to the multiplex pump. HJP's can be used across a wide range of flow rates and across a wide range of well depths, but are not able to be deployed typically past the top part of the curve in a horizontal well. HJP's also generally result in a relatively high abandonment pressure if that is the "end of life" artificial lift method when a well is abandoned.

Still another lifting method is a Plunger Lift, which is characterized by the installation of a production tubing run with a downhole profile and spring installed on the bottom joint of tubing. A "floating" plunger that travels up and down the production tubing acting as a free moving piston removes reservoir fluids from the wellbore. There is typically no external energy required, however, there are variations in this technology where plungers can operate in combination with a gas lift system. Plungers are an artificial lift method that generally only applies to low rate applications. They can be used, however, across a wide range of well depths, but are limited to having the bottom spring installed somewhere in the curve of a horizontal well. Use of a plunger lift also generally results in a relatively high abandonment pressure if that is the "end of life" artificial lift method when a well is abandoned. Plunger applications in horizontals appear to be mostly used in the "gas basins."

Another lifting method is the Progressive Cavity Pumping (PCP), which is characterized by the use of a positive displacement helical gear pump operated by the rotation of a sucker rod string with a drive motor located on the surface on the wellhead. PCP's are powered by electricity. They are tolerant of high solids and high gas fractions. They are, however, applicable mostly for lower rate wells and have higher failure rates (compared to gas lift) when operated in deviated or horizontal wells.

An artificial lift method that was only applied in the field as a solution to unload gas wells that were offline as a result of having standing fluid levels above the perforations in a vertical well is the Calliope system, which is schematically illustrated in FIG. 1 (which corresponds to FIG. 5 of U.S. Pat. No. 5,911,278). The Calliope system 100 utilizes a dedicated gas compressor 102 for each well to lower the producing pressures (compressor suction) a well 104 must overcome while using the high pressure discharge from the compression (compressor discharge) as a source of gas lift. The Calliope system was successful at taking previously dead gas wells and returning them to economic production levels and improving gas recoveries from the reservoir. Each wellsite installation has a programmable controller (not shown) that operates a manifolded system (which includes plural valves 110A to 110J) to automate the connection of the compressor suction to the casing 120, production tubing 130, and/or an inner tubing 140, or conversely, to connect the compressor discharge to these elements. Various pressure gauges 112A to 112D are used to determine when to open or close the various valves 110A to 110J. The production tubing 130 has a one way valve 132 that allows a fluid from the casing 120 to enter the lower part of the production tubing 130 and the inner tubing 140, but not the other way. The fluid flows from the formation 114 into the casing 120, through holes 116 made during the perforating operation, and into the casing production 125 tubing annulus. By connecting the discharge and suction parts of the compressor 102 to the three elements noted above, the fluid from the bottom of the well 104 is pumped up the well, to a production pipe 106. Although this method works in an efficient way in a vertical well, as illustrated in FIG. 1, the same configuration will fail in a horizontal well because valve 132 is designed in a way that only works when in a vertical well. These problems are overcome by an artificial lift system that was developed by the assignee of this application, and is described in patent application Ser. No. 16/106,099, the entire content of which is incorporated herein by reference.

However, most of the above processes share the same drawback, which is now discussed. To be able to bring the oil to the surface, a production string and an inner string (elements 130 and 140 in FIG. 1) need to be deployed to the toe of the well. Especially for long and horizontal wells, deploying such a tubing string is a difficult task due to the weight of the tubing, and the friction experienced between the tubing and the casing in the horizontal portion of the well. For the above discussed methods, it is necessary to first deploy the production string all the way to the toe of the well, and then to deploy the inner string, inside the production string, also all the way to the toe of the well. The friction experienced between these two strings can be large, which make the deploying process more difficult. This is a time consuming and difficult process. Sometimes, this process is not practical.

Thus, there is a need to provide a tubing system and method that overcome the above noted problems and offer to the operator of the well a much simplified and economical way to extract the oil from the well.

SUMMARY

According to an embodiment, there is a joint pipe element for transporting a fluid in a well. The joint pipe element includes an outer pipe having first threads at a first end; an inner pipe having first threads at a first end, the inner pipe being located inside the outer pipe; and plural lugs located between the outer pipe and the inner pipe. The first threads of the first end of the outer pipe and the first threads of the first end of the inner pipe have the same number of teeth per unit length so that the outer pipe and the inner pipe are connected, simultaneously, by a single rotational motion, to another joint pipe element.

According to another embodiment, there is a tubing system for extracting oil from a well. The tubing system includes a first joint pipe element having an inner pipe fixedly attached to an inside of an outer pipe; and a second joint element having an inner pipe fixedly attached to an inside of an outer pipe. An upstream end of the first joint element is attached to a downstream end of the second joint element with a single rotational motion.

According to yet another embodiment, there is a method for assembling a tubing system for extracting oil from a well, the method including providing a first joint pipe element having an inner pipe fixedly attached to an inside of an outer pipe; providing a second joint element having an inner pipe fixedly attached to an inside of an outer pipe; and connecting an upstream end of the first joint element to a downstream end of the second joint element with a single rotational motion.

According to yet another embodiment, there is a connector for attaching joint pipe elements for forming an artificial lift system for a well. The connector includes a body having a bore that extends along a longitudinal axis; an upstream part having internal threads; a downstream part having internal threads; and a shoulder formed inside the bore. The upstream part is configured to engage with an inner pipe or an outer pipe of a first joint pipe element, and the downstream part is configured to engage with an inner pipe or an outer pipe of a second joint pipe element, so that an inner and an outer tubular string are formed.

According to yet another embodiment, there is an artificial lift system for a well, the system including a connector having a bore that extends along a longitudinal axis; a first joint pipe element having an inner pipe and an outer pipe, the inner pipe being fixedly attached to an inside of the outer pipe and a second joint pipe element having an inner pipe and an outer pipe, the inner pipe being fixedly attached to an inside of the outer pipe. The first joint pipe element and the second joint pipe element are configured to attach to opposite ends of the connector to form an outer tubular string and an inner tubular string.

According to another embodiment, there is a method for forming an artificial lift system for a well, the method including attaching a first end of a connector to a first joint pipe element, wherein the first joint pipe element has an inner pipe and an outer pipe, the inner pipe being fixedly attached to an inside of the outer pipe; and attaching a second end of the connector to a second joint pipe element, wherein the second joint pipe element has an inner pipe and an outer pipe, the inner pipe being fixedly attached to an inside of the outer pipe. The first joint pipe element, the connector, and the second joint pipe element form an outer tubular string and an inner tubular string.

According to still another embodiment, there is a connector for attaching joint pipe elements for forming an artificial lift system for a well. The connector includes an outer body having a bore; an inner body fixedly attached to an inside of the bore; and a bridge that physically connects the outer body to the inner body. Each end of the outer body and the inner body has a corresponding thread.

According to another embodiment, there is a system for attaching joint pipe elements for forming an artificial lift system for a well. The system includes a connector having a bore and an annulus; a first joint pipe element configured to be attached to a first end of the connector with a single rotational motion; and a second joint pipe element configured to be attached to a second end of the connector with another single rotational motion. The connector, the first joint pipe element, and the second joint pipe element form an inner tubular string and an outer tubular string that provide independent flow paths.

According to another embodiment, there is a method for forming an artificial lift system for a well. The method includes attaching by a single rotational motion, a first end of a connector to a first joint pipe element; and attaching by another single rotational motion, a second end of the connector to a second joint pipe element. The connector, the first joint pipe element, and the second joint pipe element form an inner tubular string and an outer tubular string that provide independent flow paths.

According to another embodiment, there is a well servicing tool for moving oil through a well. The tool includes an outer pipe having a bore; an inner pipe extending inside the bore of the outer pipe; and an oil extracting instrument configured to be in fluid communication with the inner pipe. The inner pipe is fixedly attached to the outer pipe so that a torque applied to the outer pipe simultaneously rotates the outer pipe and the inner pipe.

According to yet another embodiment, there is a system for attaching a joint pipe element to a well servicing tool for forming an artificial lift system for a well. The system includes a connector having a bore and an annulus; the joint pipe element configured to be attached to a first end of the connector with a single rotational motion; and the well servicing tool configured to be attached to a second end of the connector with a single rotational motion. The connector, the joint pipe element, and an upstream part of the well servicing tool form an inner tubular string and an outer tubular string that provide independent flow paths.

According to yet another embodiment, there is a system for attaching a joint pipe element to a well servicing tool for forming an artificial lift system for a well. The system includes the joint pipe element; and the well servicing tool configured to be attached directly to an end of the joint pipe element with a single rotational motion. The joint pipe element and an upstream part of the well servicing tool form an inner tubular string and an outer tubular string that provide independent flow paths.

According to another embodiment, there is a method of forming inner and outer tubular strings for a well. The method includes providing a connector that has a bore and an annulus; attaching a joint pipe element to a first end of the connector with a single rotational motion; and attaching a well servicing tool to a second end of the connector with a single rotational motion. The connector, the joint pipe element, and an upstream part of the well servicing tool form the inner tubular string and the outer tubular string, which provide independent flow paths.

According to another embodiment, there is a tubing system configured to lift oil from a well. The system includes a joint pipe element having concentric outer and inner pipes; and a production unit attached to the outer and inner pipes of the joint pipe element by a single rotational motion. The joint pipe element and an upstream part of the production unit form an inner tubular string and an outer tubular string that provide independent flow paths.

According to yet another embodiment, there is a method for connecting a joint tube element to a production unit for extracting oil from a well. The method includes providing a joint pipe element having concentric outer and inner pipes; and attaching each of the outer and inner pipes of the joint pipe element to a production unit by a single rotational motion. The joint pipe element and an upstream part of the production unit form an inner tubular string and an outer tubular string that provide independent flow paths.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

Figure 1:
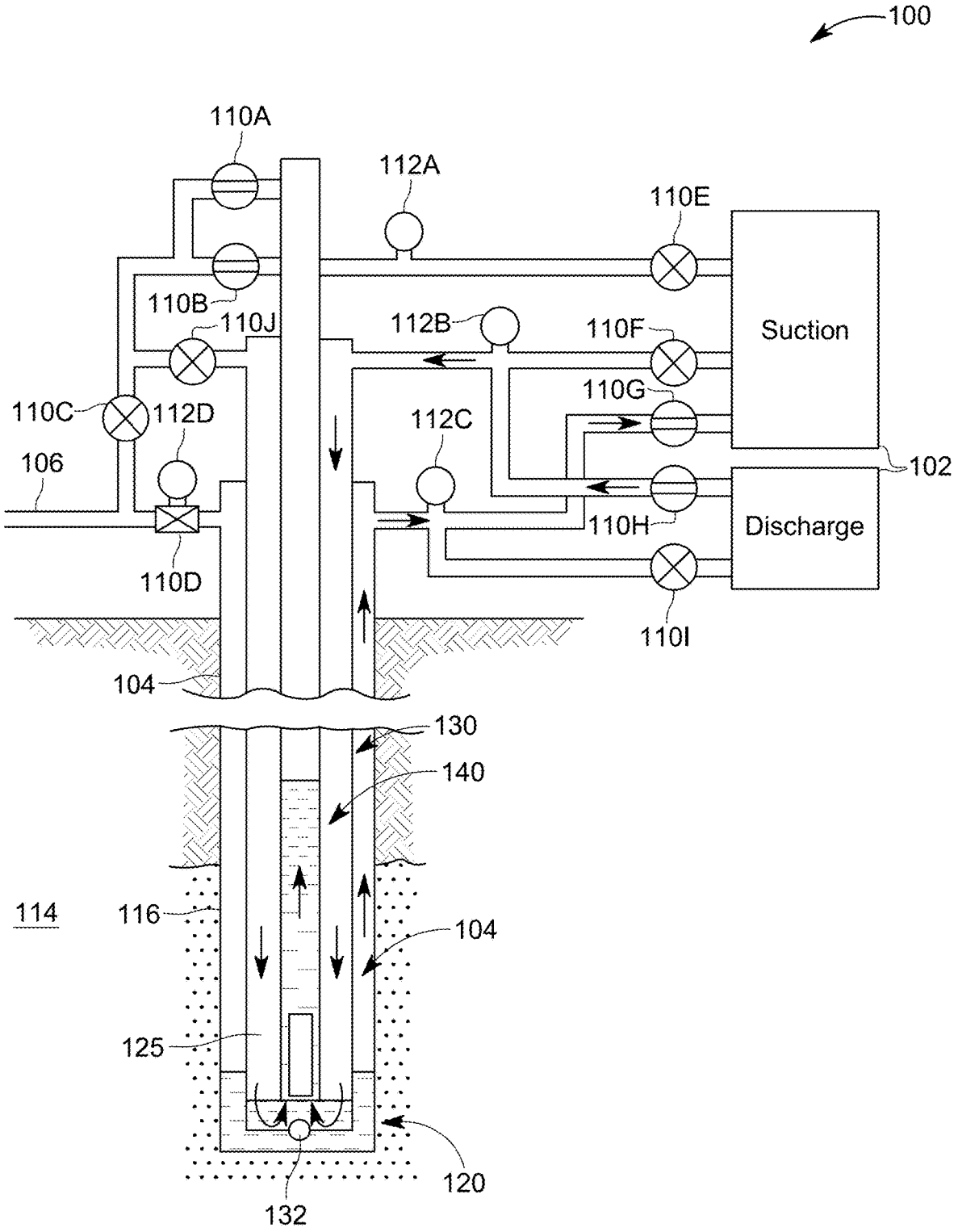
FIG. 1 illustrates a vertical well and associated equipment for well production operations.

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a tubing system that includes two tubular strings that are used for lifting a fluid from a horizontal well. However, the embodiments discussed herein are also applicable to a vertical well or to a tubing system that has more than two tubular strings.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a tubing system includes outer and inner tubular strings, where the inner tubular string is located inside the outer tubular string. Each of the inner and outer tubular strings is made of plural pipes. A single pipe of the inner tubular string and a single pipe of the outer tubular string are fixedly attached to each other to form a single unit, which is called herein a joint pipe element. At least one end of the joint pipe element is threaded in a such a way that when connected to another threaded end of another joint pipe element, inner pipes of the two joint pipe elements have matching threads that connect to each other and the outer pipes of the two joint pipe elements also have matching threads that connect to each other, as male/female connectors. This means that by applying a torque to the outer pipe of one joint pipe element to connect it to another outer pipe of another joint pipe element, the inner pipes of these two joint pipe elements automatically are engaging each other, i.e., the threads of the inner and outer pipes are simultaneously mating to each other by applying a rotational motion only to one or both of the outer pipes.

This also means that at least four different pipes, belonging to the two different joint pipe elements, can be connected to each other through a single rotational motion. This further means that the outer tubular string and the inner tubular string are formed simultaneously, by connecting a joint pipe element to another joint pipe element, which is different from the traditional methods that form first the outer tubular string, and then the inner tubular string.

In other words, the outer and inner tubular strings are not formed consecutively or in parallel, as is the practice in the art, but rather they are formed simultaneously, with the inner tubular string located inside the outer tubular string. Thus, in one application, it is possible to install simultaneously two or more pressure autonomous, concentric or partially concentric, tubing strings into the casing of a subsurface well, as one tubular unit, instead of consecutively installed concentrically or in parallel. This process is very efficient and time saving as the operator does not have to manually engage the inner pipes to each other and apply a separate torque to each inner pipes for building up the inner tubular string, in addition to forming the outer tubular string.

Figure 2:
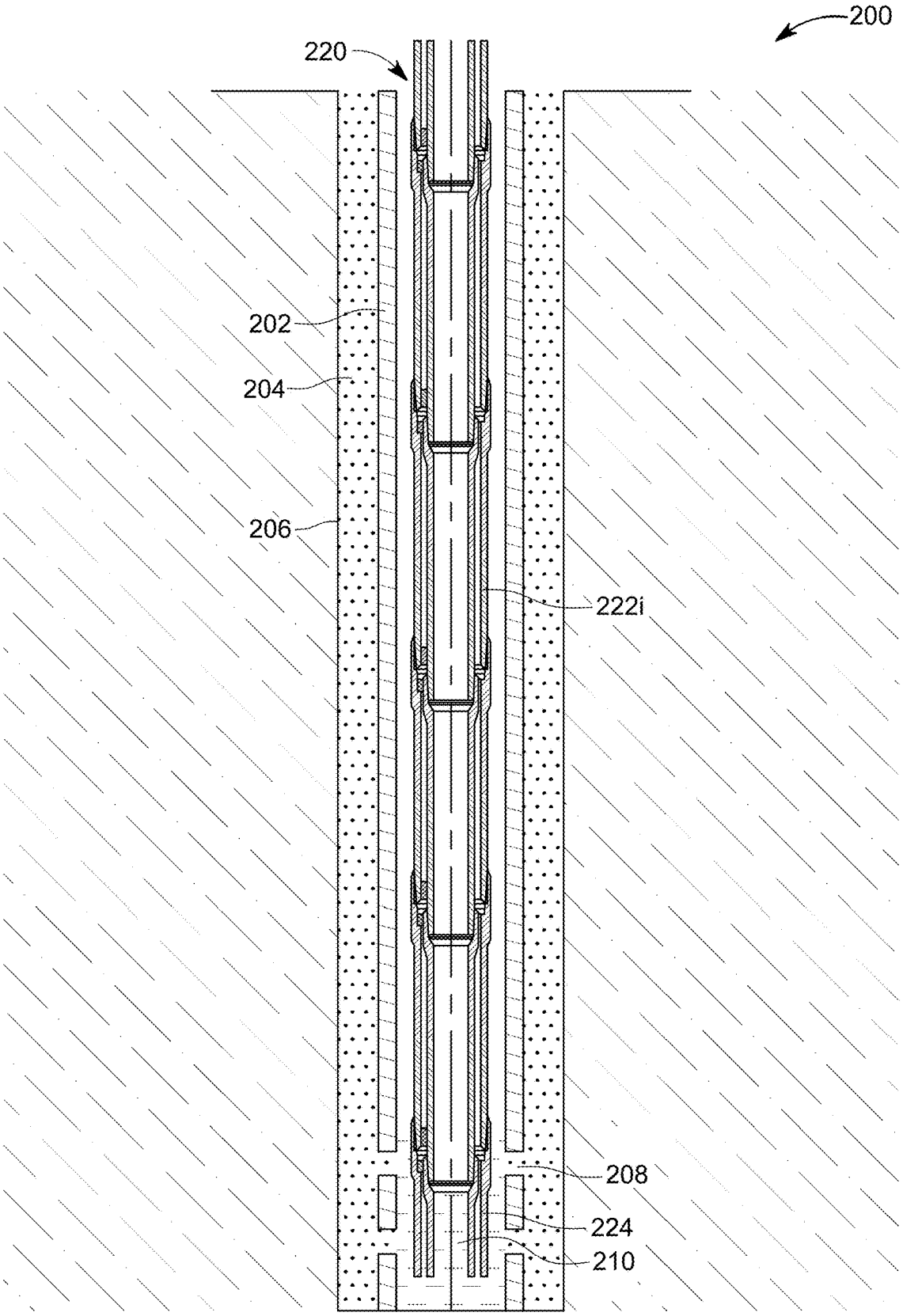
FIG. 2 illustrates a tubing system that is made of plural joint tube elements.

FIG. 2 shows an oil well 200 in which a casing 202 has been installed. Casing 202 has been cemented with cement 204 inside the well 206. Plural perforations 208 have been formed at least at the bottom of the well (in fact, these perforations are formed at various stages of the casing) so that oil 210 from the formations around the well 206 is flowing inside the casing 202. A tubing system 220 has been lowered into the casing 202 to lift the oil. The tubing system 220 is made of plural joint pipe elements 222*i*, with i being any integer equal to or larger than 2. The bottom joint pipe element 224 may have a configuration different from the joint pipe element 222*i*, which is discussed later.

Figure 3:
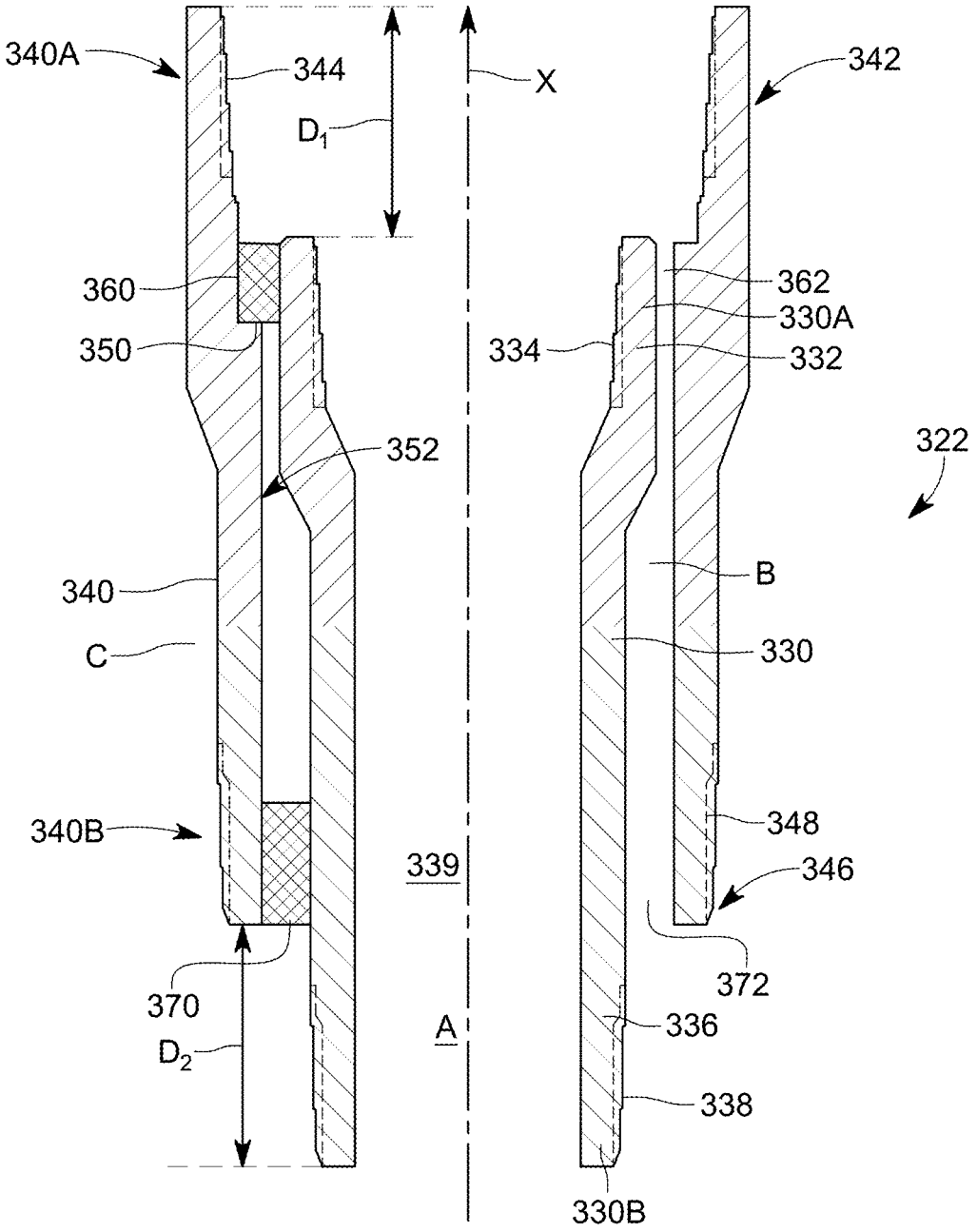
FIG. 3 illustrates a joint tube element that includes concentric inner and outer pipes fixedly connected to each other.

FIG. 3 shows a single joint pipe element 322 having an inner pipe 330 and an outer pipe 340. The upstream end 340A of the outer pipe 340 has an outer tubular box 342, formed for example, by upsetting or forging (or any known process). In this embodiment, an internal thread (female) 344 is formed on the internal part of the outer tubular box 342. The downstream end 340B of the outer pipe 340 is shaped as a tubular pin 346 having an external thread (male) 348, that would mate with a corresponding thread 344 of a next single joint pipe element (not shown).

Figure 4:
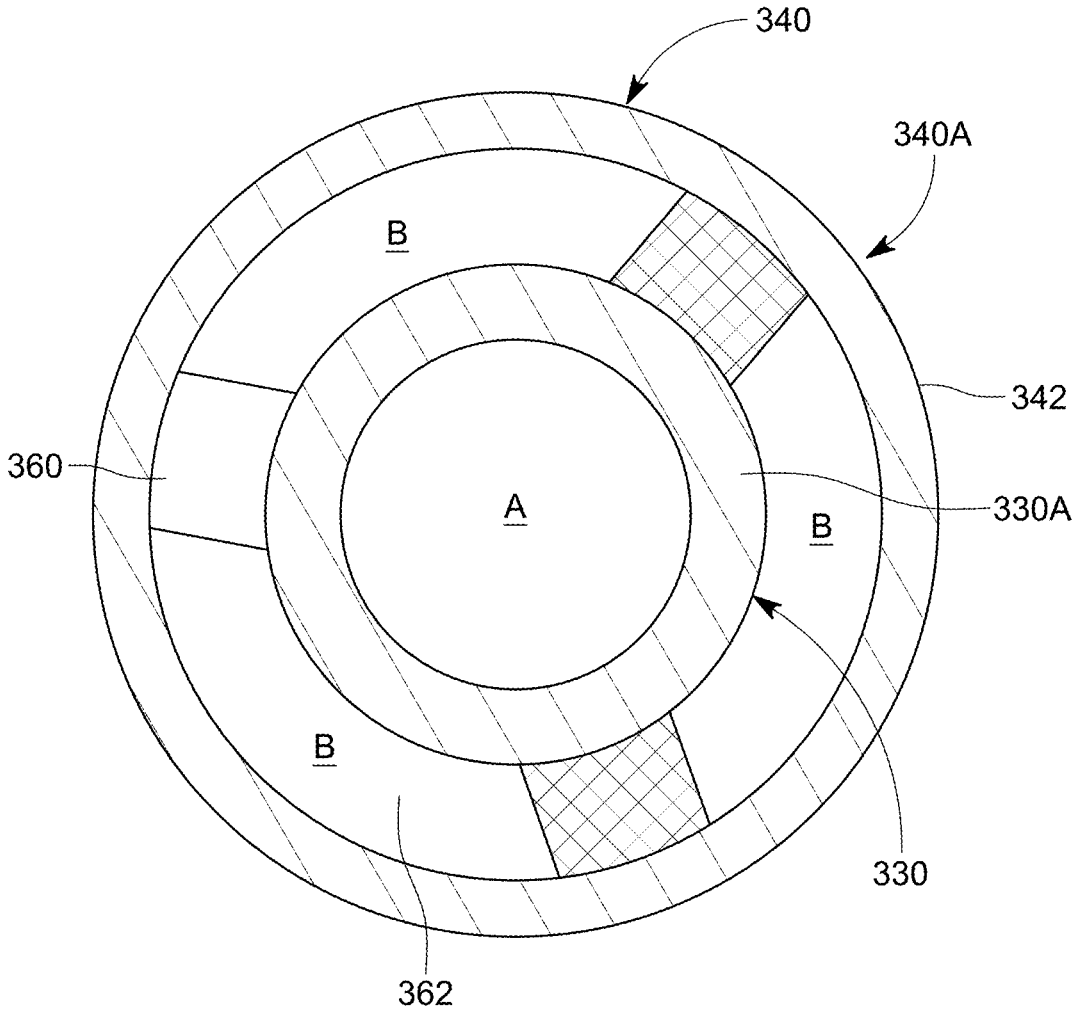
FIG. 4 shows a cross-section of a joint tube element.

Two or more upstream lugs 360 are attached (for example, welded) to the inner pipe 330 as shown in FIG. 3. The term "lug" is used herein to include any means of connecting the inner pipe to the outer pipe in order to transfer rotational torque and share tensile and compression loads, and this term may include, but it not limited to, a slug, a weld, a centralizer, or full or partial length feature on the inner or outer string, or a combination of features and other parts. Further, the term may include a key formed in one pipe and an extension formed in the other pipe and the extension is configured to engage the key formed in the other pipe. Other similar or equivalent mechanisms are intended to be covered by this term as long as the two pipes are attached to each other in such a way to transfer rotational torque from the outer pipe to the inner pipe and share tensile and compression loads. Note that FIG. 3 shows only a single upstream lug 360 as this figure is a longitudinal cross-section view of the single joint pipe element 322. FIG. 4 shows a top of the single joint pipe element 322 and shows three different upstream lugs 360 being located between the inner pipe 330 and the outer pipe 340. However, more or less lugs may be used and the shape of these lugs may be selected as necessary by the manufacturer of the joint pipe element. The inner pipe 330 is shown having a bore (called herein annulus A as it is customary in the industry, although a bore is different from an annulus), and the slots 362 between the upstream lugs 360 allow the gas or fluid to pass from one single joint pipe element to another through annulus B, which is defined by the internal part of the outer pipe 340 and the external part of the inner pipe 330. The annulus A is in fact the fluid path of the inner tubing string and annulus B is the fluid path between the inner tubing string and the outer tubing string.

Lug 360 is in contact with the outer pipe 340 and may be attached to it also by welding. However, in another embodiment, the lugs 360 are welded to the inner pipe 330 and then this assembly is fit-pressed inside the outer pipe 340, with no welding. The lugs 360 may engage with a corresponding shoulder 350 of the outer pipe 340, as discussed later. Because the size of the lugs may be a little larger than the size of the annulus B, by pressing the lugs between the two pipes makes the connection of the inner and outer pipes to be strong, i.e., a torque applied to the outer pipe is transmitted to the inner pipe and thus, the inner pipe cannot rotate relative to the outer pipe or vice versa, and the two pipes act as a single unit under rotation. Other methods for attaching the lugs to the inner and outer pipes may be used. It is noted that the inner pipe cannot rotate relative to the outer pipe for any of the joint pipe elements discussed herein because of these lugs. In this way, the torque applied to the outer pipe of a joint pipe element is conveyed though the lugs to the inner pipe, thus insuring that all the threads in the joint pipe element are sufficiently tightened when forming a tubing system. This is valid irrespective of the manufacturing method selected for forming the joint pipe element, i.e., the lugs are welded, or just pressed, or forged, etc.

Returning to FIG. 3, in one application, the shoulders 350 are formed in the bore 352 of the outer pipe 340 so that, when the inner pipe 330 and the upstream lugs 360 are placed inside the outer pipe 340, the lugs 360 stop their movement along the X axis when contacting the corresponding shoulder 350. The number of shoulders coincide with the number of lugs. The shoulder 350 is made so that an alignment of the inner pipe relative to the outer pipe along the longitudinal axis X is achieved. For example, in the embodiment of FIG. 3, the top most part of the inner pipe 330 is offset from the top most part of the outer pipe 340 by a distance D1. In one application, the distance D1 is between a couple of millimeters to a couple of centimeters. In still another application, the distance D1 may be zero, i.e., the top most part of the outer pipe may be flush with the top most part of the inner pipe.

Still with regard to FIG. 3, the inner pipe 330 is made to have an upstream end 330A and a downstream end 330B that are both treaded. The upstream end 330A has an inner tubular box 332 that has internal (female) threads 334. The inner tubular box 332 may be made, in one application, by upset forging. Other methods may be used to form this part. The downstream end 330B has an inner tubular pin 336 having an external (male) thread 338. The inner pipe 330 has a bore 339 (that forms annulus A of the inner tubular string) through which a tool may be lowered into the well or oil may be brought to the surface. As previously discussed, the bore 339 of the inner pipe 330 is called annulus A, the passage between the inner pipe 330 and the outer pipe 340 is called annulus B, and the passage between the outer pipe 340 and the casing (not shown) is called the annulus C.

Figure 5:
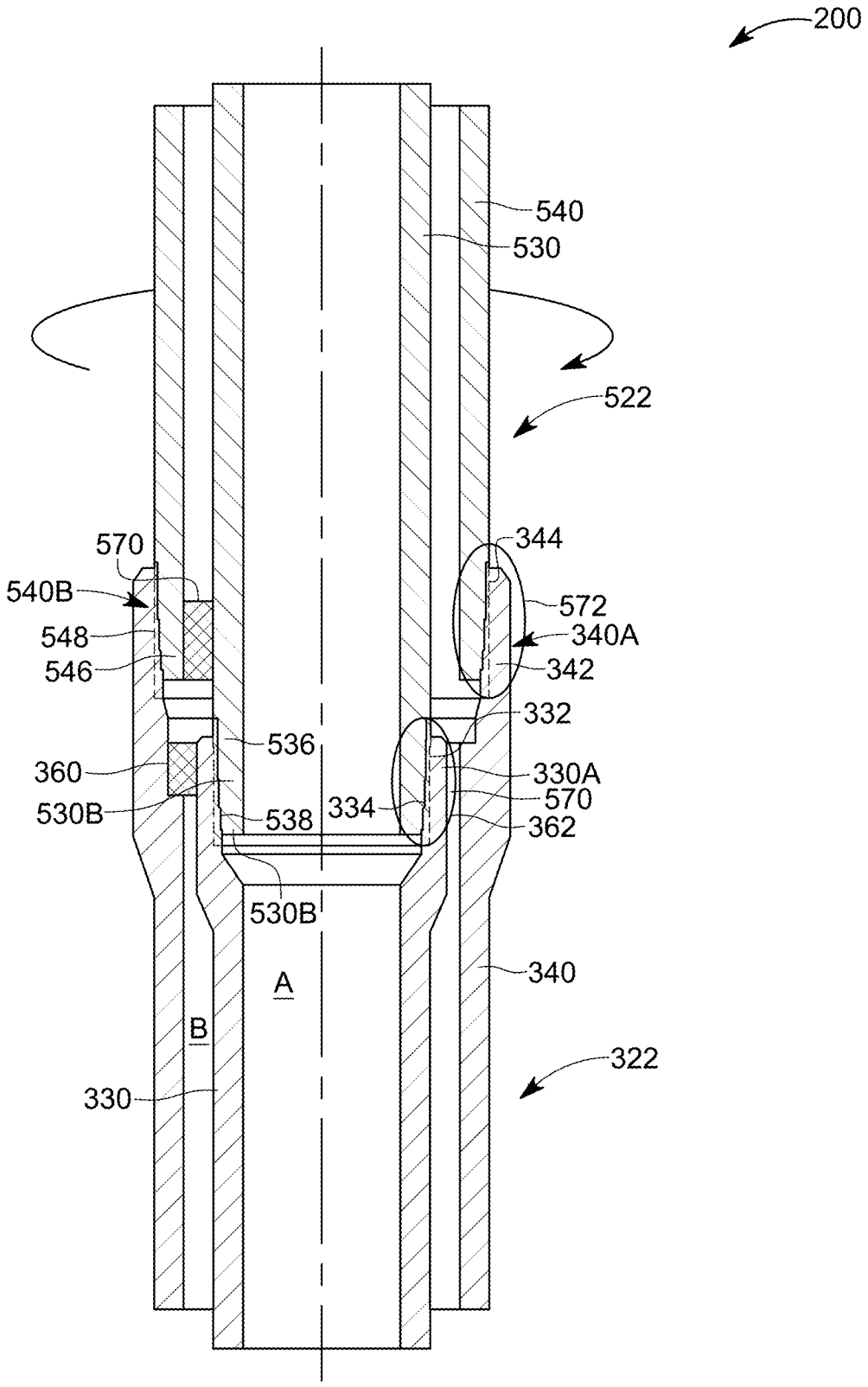
FIG. 5 shows two joint tube elements directly connected to each other.

For aligning the inner pipe 330 relative to the outer pipe 340, in addition to the upstream lugs 360 discussed above, downstream lugs 370 may be used at the downstream end of the outer and inner pipes. Two or more downstream lugs 370 may be used. FIG. 3 shows that slots 372 are formed between the downstream lugs 370, similar or not to the slots 362, for allowing a gas or fluid to pass by. Although FIG. 3 shows the inner pipe 330 being concentric relative to the outer pipe 340, it is possible that only one or both ends of the two pipes to be concentric, while the body (the part between the ends) is not concentric, as discussed later. One or both ends of the two pipes are concentric because when one joint pipe element is attached to another joint pipe element, as illustrated in FIG. 5, the inner pipe and the outer pipe of one joint pipe element are screwed into the corresponding parts of the other joint pipe element at once, as now discussed. Note that the terms "downstream" and "upstream" in this application refer to a direction toward the toe of the well and a direction toward the head of the well, respectively.

FIG. 5 shows a joint pipe element 322 (the one discussed with regard to FIG. 3) connected to another joint pipe element 522 (which is similar to the one discussed with regard to FIG. 3). The joint pipe element 522 is shown having the downstream end entering into the upstream end of the joint pipe element 322, thus achieving a direct connection between the inner pipes and another direct connection between the outer pipes of the two joint pipe elements. More specifically, the threads 538 of the inner tubular pin 536 of the inner pipe 530 are directly engaged with the threads 334 of the inner tubular box 332 of the inner pipe 330, as shown by region 570, while the outer threads 548 of the outer tubular pin 546 of the outer pipe 540 are directly engaged with the threads 344 of the outer tubular box 342 of the outer pipe 340, as shown by region 572.

As previously discussed, the threads present in the regions 570 and 572, which correspond to the inner pipes and the outer pipes, respectively, from the two single joint pipe elements 322 and 522, engage simultaneously to each other so that in the field, there is no need to first connect the inner pipes and then the outer pipes. This means that this coupling/assembling operation is now performed in a single step with a single torque being applied to the outer pipe, which is automatically transmitted by the lugs to the inner pipe. The term "simultaneously" is used herein to mean that for at least a period of time during the coupling operation (not necessary the entire period, i.e., the at least a period of time may be less than the entire time period needed to fully engage the two single joint pipe elements), the threads 344 and 548 of the outer pipes are rotatably engaged to each other, and the threads 334 and 538 of the inner pipes are rotatably engaged to each other at the same time. However, in one application, it is possible that the length of one of the threads 344 and 548 is shorter than the other, or the length of one of the threads 334 and 538 is shorter than the other, which means that the threads in one of the regions 570 or 572 may be engaged to each other while the threads in the other one of the regions 570 and 572 are not yet engaged to each other. However, during the coupling operation, it would be a time period when all these threads are engaged to each other by applying a torque to one of the outer pipes.

To achieve the simultaneous connection of the inner and outer pipes of the two joint pipe elements 322 and 522, the first threads 344 of the upstream end 340A of the outer pipe 340 and the first threads 334 of the upstream end 330A of the inner pipe 330 have the same number of teeth per unit length. The term "same number of teeth per unit length" is understood herein to mean that two threads that have the same number of teeth per unit length, when engaged to each other, would fit each other and would achieve a solid connection between them. Thus, this term also covers the situation when the two threads have a same pitch between the teeth or any other description of two different threads that are designed to be compatible with each other. Further, the threads 548 of the end 540B of the outer pipe 540 and the threads 538 of the end 530B of the inner pipe 530 have the same number of teeth per unit length. In one application, the number of teeth per unit length for all the threads of the joint pipe elements 322 and 522 are the same so that the outer pipe and the inner pipe of one joint pipe element are connected, simultaneously, by a single rotational motion, to the outer pipe and inner pipe of the other joint pipe element. The term "single rotational motion" is understood herein as meaning that once two joint pipe elements or, as will be discussed later, a joint pipe element and a connector, or a joint pipe element and a well servicing tool, or a joint pipe element and a production tubing, are placed together and one is rotated relative to another one for any amount of time (or any angle), both the inner pipe and the outer pipe of the joint pipe element engage corresponding threads of the other joint pipe element or connector or tool or production tubing, and this rotational motion is applied only to the outer pipe as the inner pipe follows the same rotational motion as the outer pipe due to the inner pipe's lack of ability to rotate independent of the outer pipe. In other words, because the inner pipe and the outer pipe are fitted as a single unit (for example, due to the upstream lugs, or the downstream lugs or both), it is enough to rotate only the outer pipe to engage the threads of both the outer and inner pipes with corresponding threads of another joint pipe element or connector or well servicing tool or production tubing.

Figure 6:
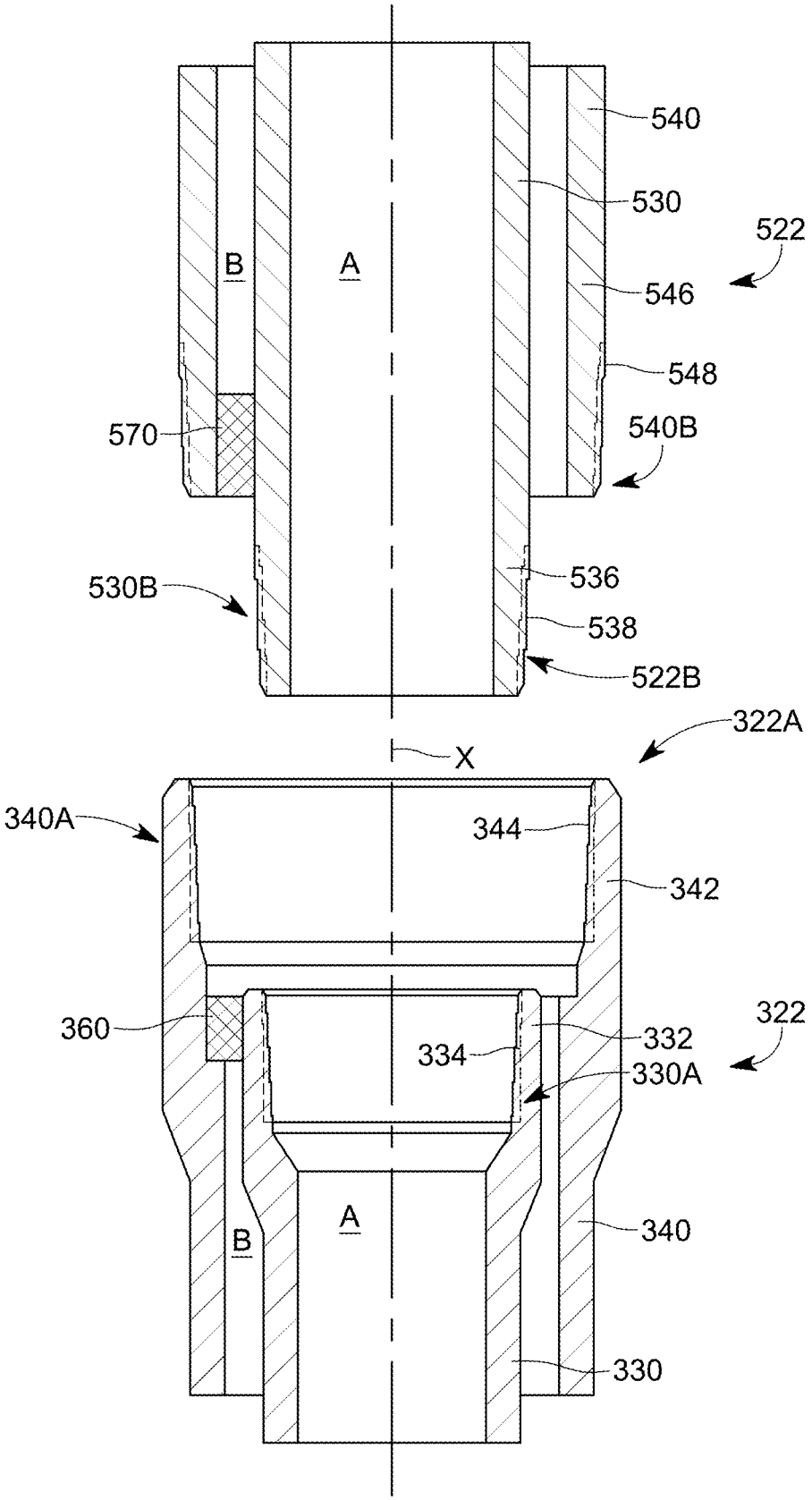
FIG. 6 shows two joint tube elements prior to being connected to each other.
Figure 7A:
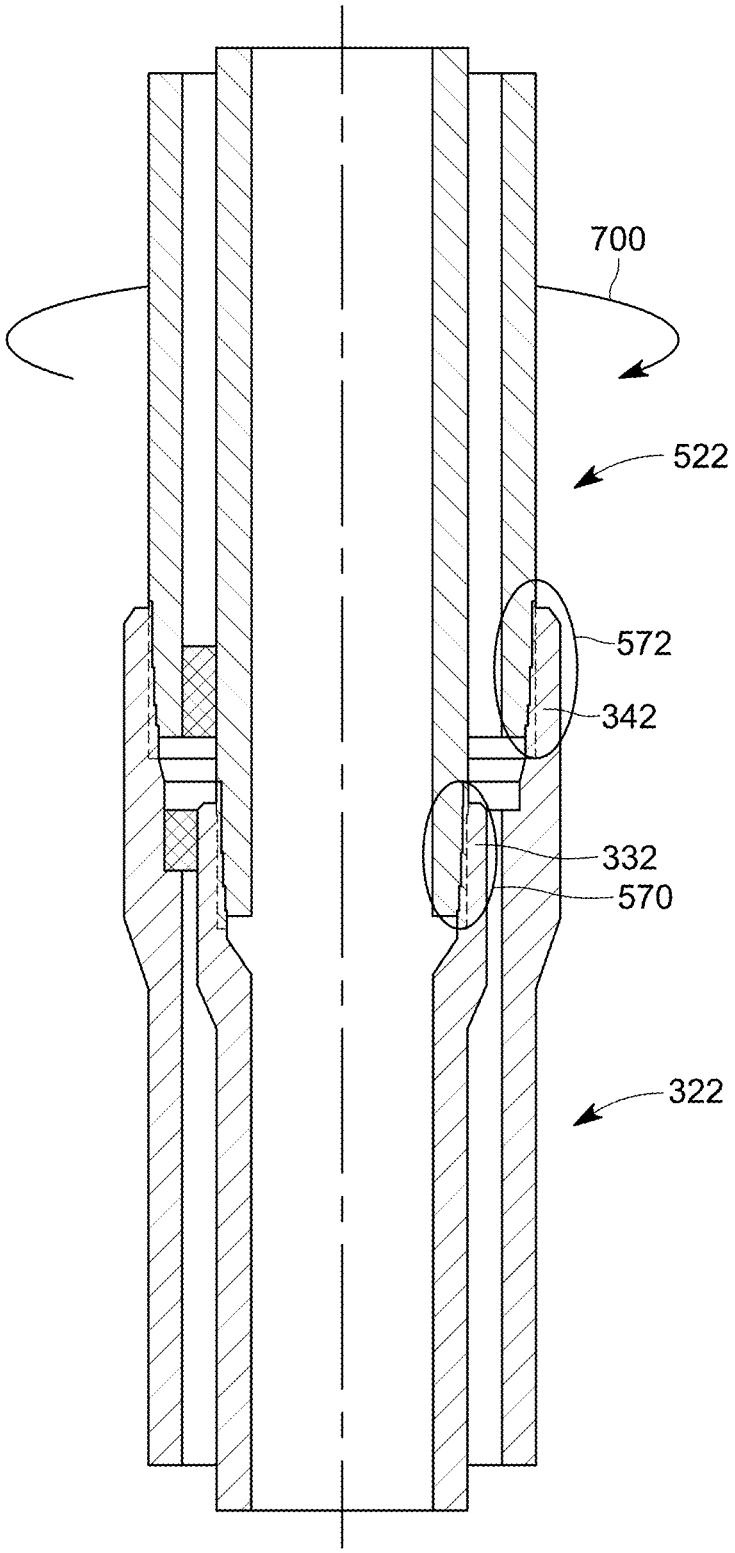
FIGS. 7A-7D show threaded connections between the joint pipe elements, located inside or outside the inner and outer pipes.
Figure 7B:
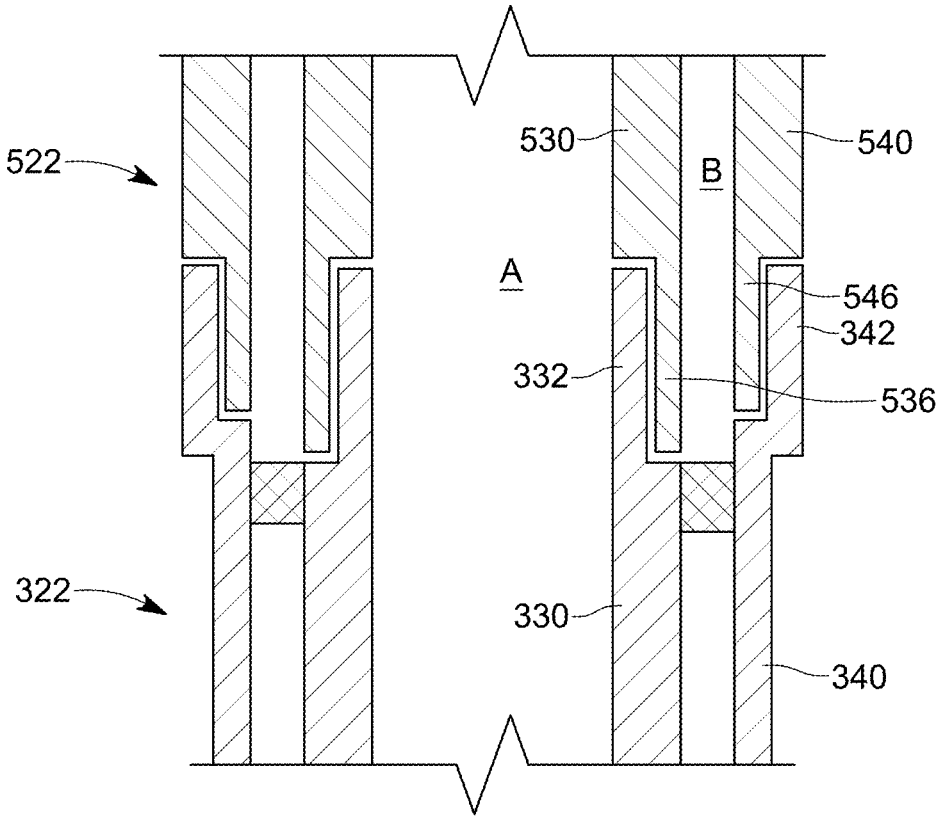
Figure 7C:
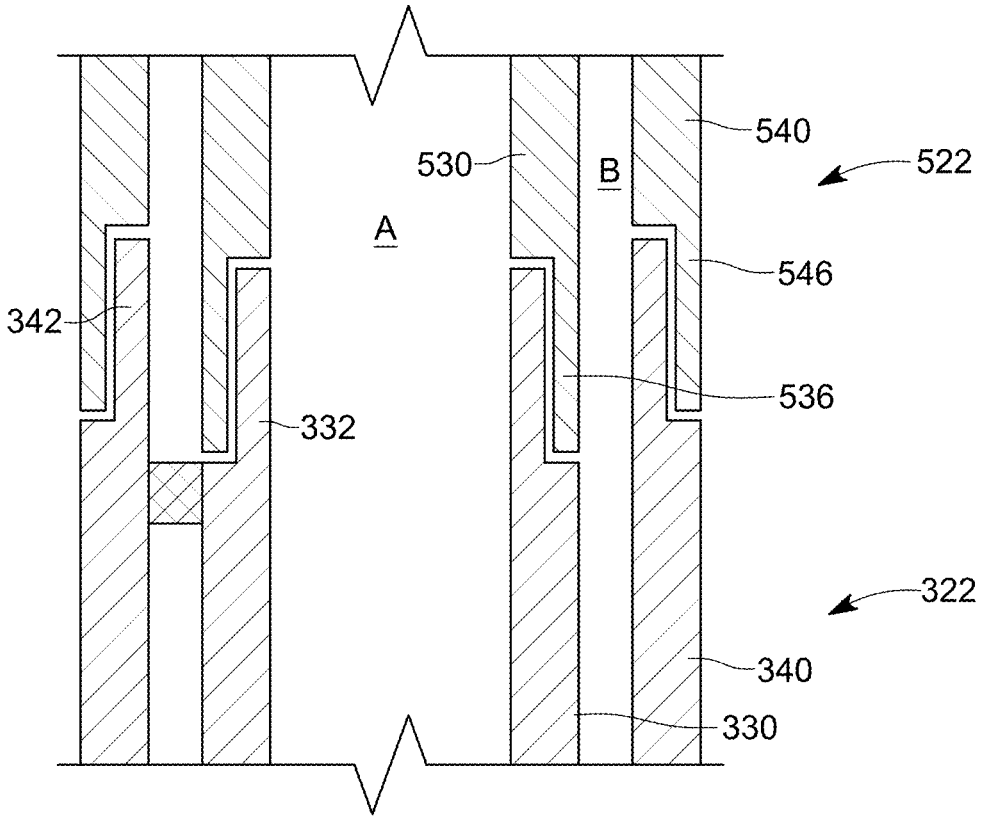
Figure 7D:
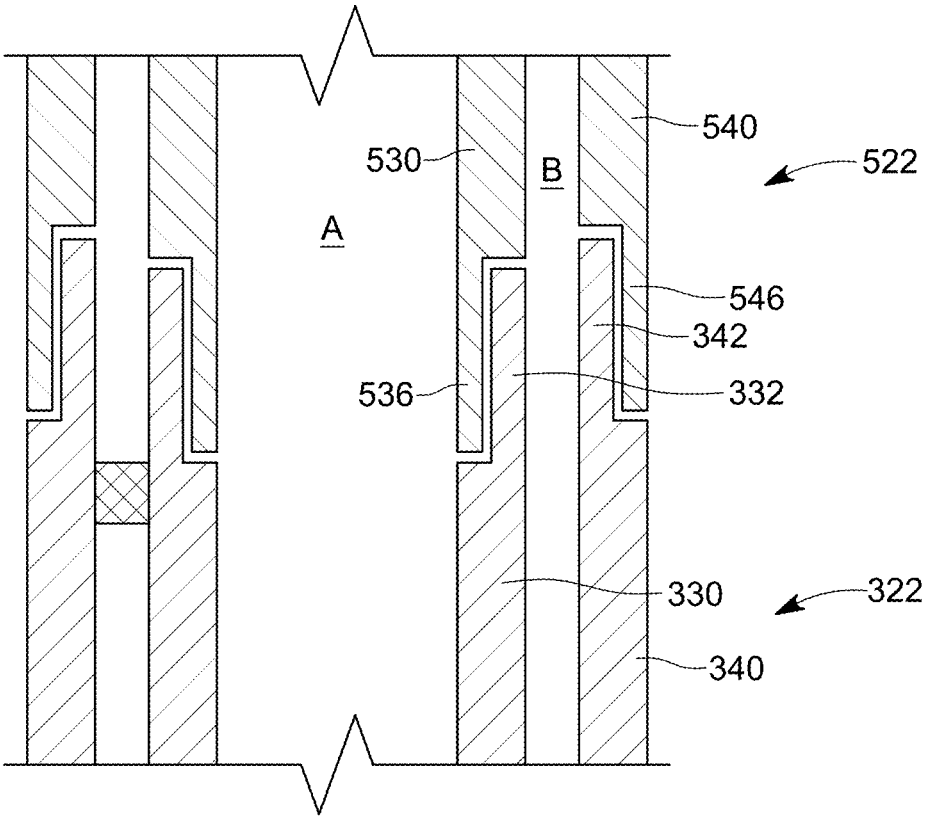

In this regard, FIG. 6 shows the upstream end 322A of the joint pipe element 322 facing the downstream end 522B of the other joint pipe element 522 just before the two elements are joined together and FIG. 7A shows how a single rotational motion 700 of the joint pipe element 522 relative to the joint pipe element 322 achieves the simultaneous engagement of the threads of the inner and outer pipes at regions 570 and 572. Although FIG. 7A shows an embodiment where the joint pipe element 322 has an inner tubular box 332 and an outer tubular box 342 at the upstream end, it is also possible that the joint pipe element 322 has an inner tubular pin 332 and an outer tubular box 342 as shown in FIG. 7B, or an inner tubular pin 332 and an outer tubular pin 342 as shown in FIG. 7C, or an inner tubular box 332 and an outer tubular pin 342 as shown in FIG. 7D. The threads between the various pins and boxes are omitted in these figures for simplicity.

Figure 8:
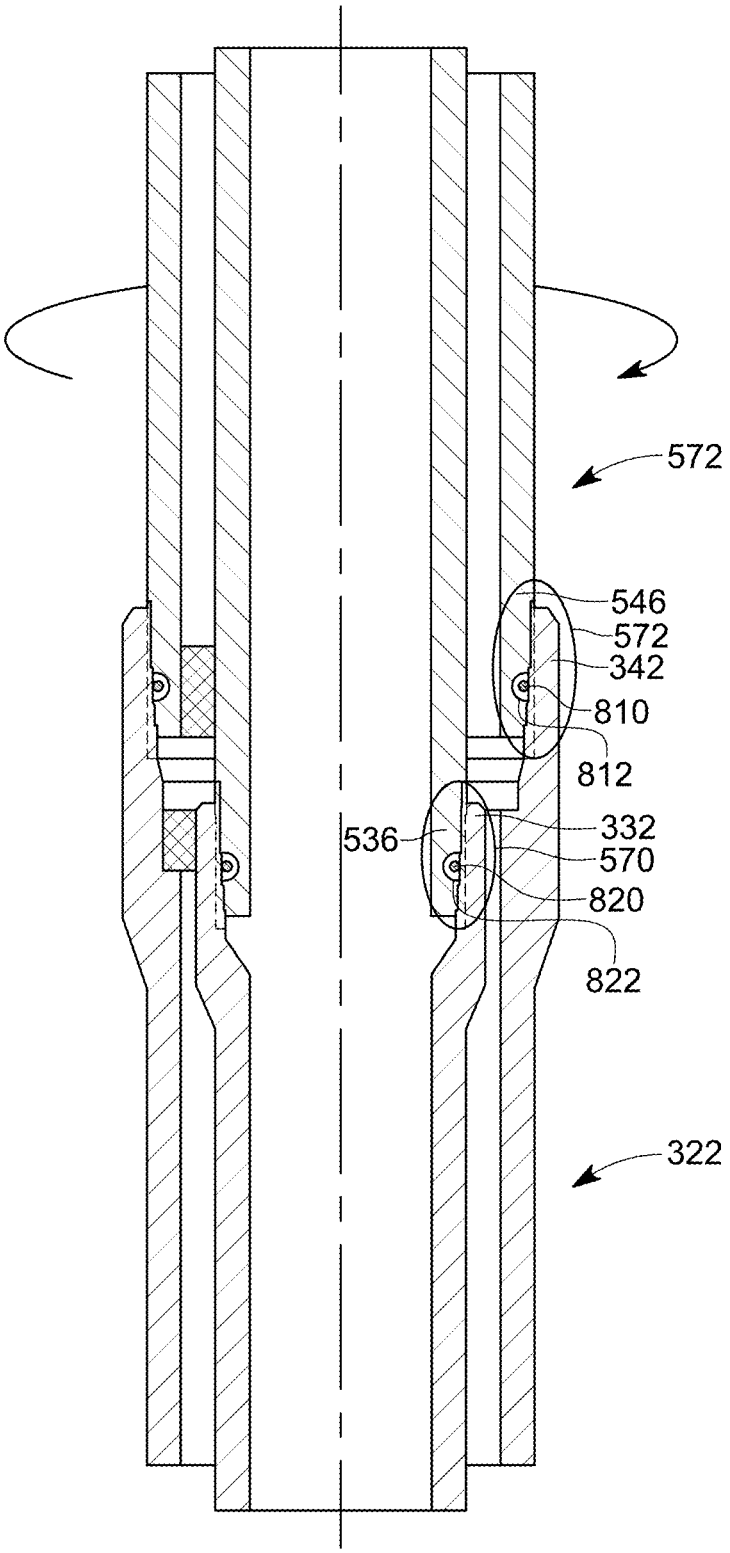
FIG. 8 shows two joint pipe elements connected with threads to each other and also having a sealing element.

The threads between the upstream and downstream inner pipes and the upstream and downstream outer pipes of the various joint pipe elements are machined so that no pressured gas or liquid is leaking through them. In one application, it is possible to place an O-ring 810 or similar seal, as shown in FIG. 8, into a corresponding groove 812, formed either in the outer tubular pin 546 or into the outer tubular box 342, so that a better seal is achieved between the upstream and downstream outer pipes. In another application, it is possible to place an O-ring 820 into a corresponding grove 822, formed either in the inner tubular box 332 or into the inner tubular pin 536, so that a better seal is achieved between the upstream and downstream inner pipes. In one application, both O-rings 810 and 820 are used. Those skilled in the art will understand that the O-rings may also be located at other points along the inner and outer pipes.

Figure 9:
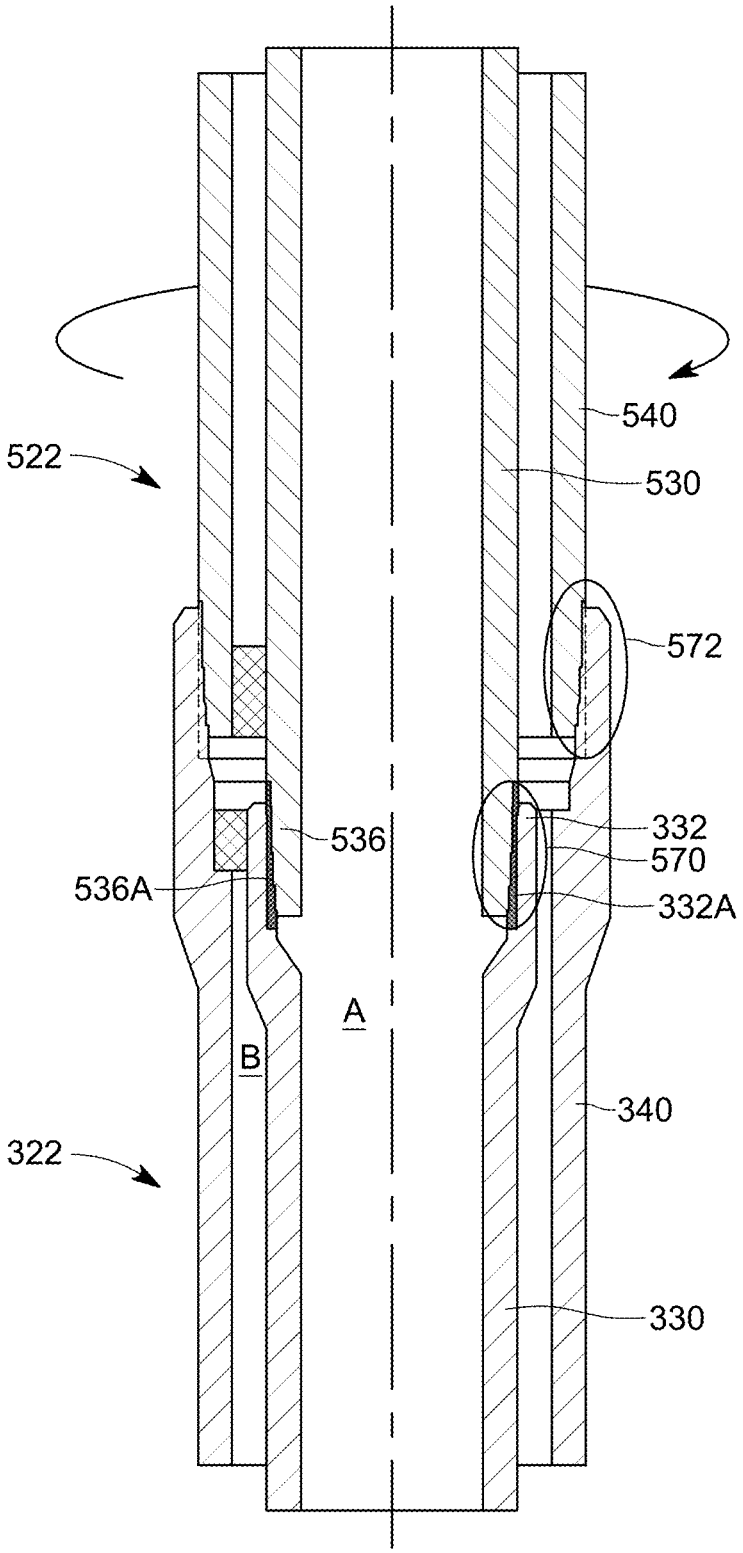
FIG. 9 shows two joint pipe elements having a metal-to-metal connection between the inner pipes and a threaded connection between the outer pipes.

In the embodiment shown in FIG. 9, the threads 334 and 538 in the region 570 of FIG. 5 are replaced by a stab-in mechanism, i.e., the surfaces 332A and 536A of the inner tubular box 332 and the inner tubular pin 536 are manufactured to achieve a metal-on-metal seal, which prevents a fluid from annulus A to leak into annulus B and vice versa. Other types of seals may be used between the inner pipes that do not make use of threads. In this regard, note that the threads formed between the outer pipes (i.e., those threads in region 572) are enough to hold the weight of the tubular strings.

Figure 10:
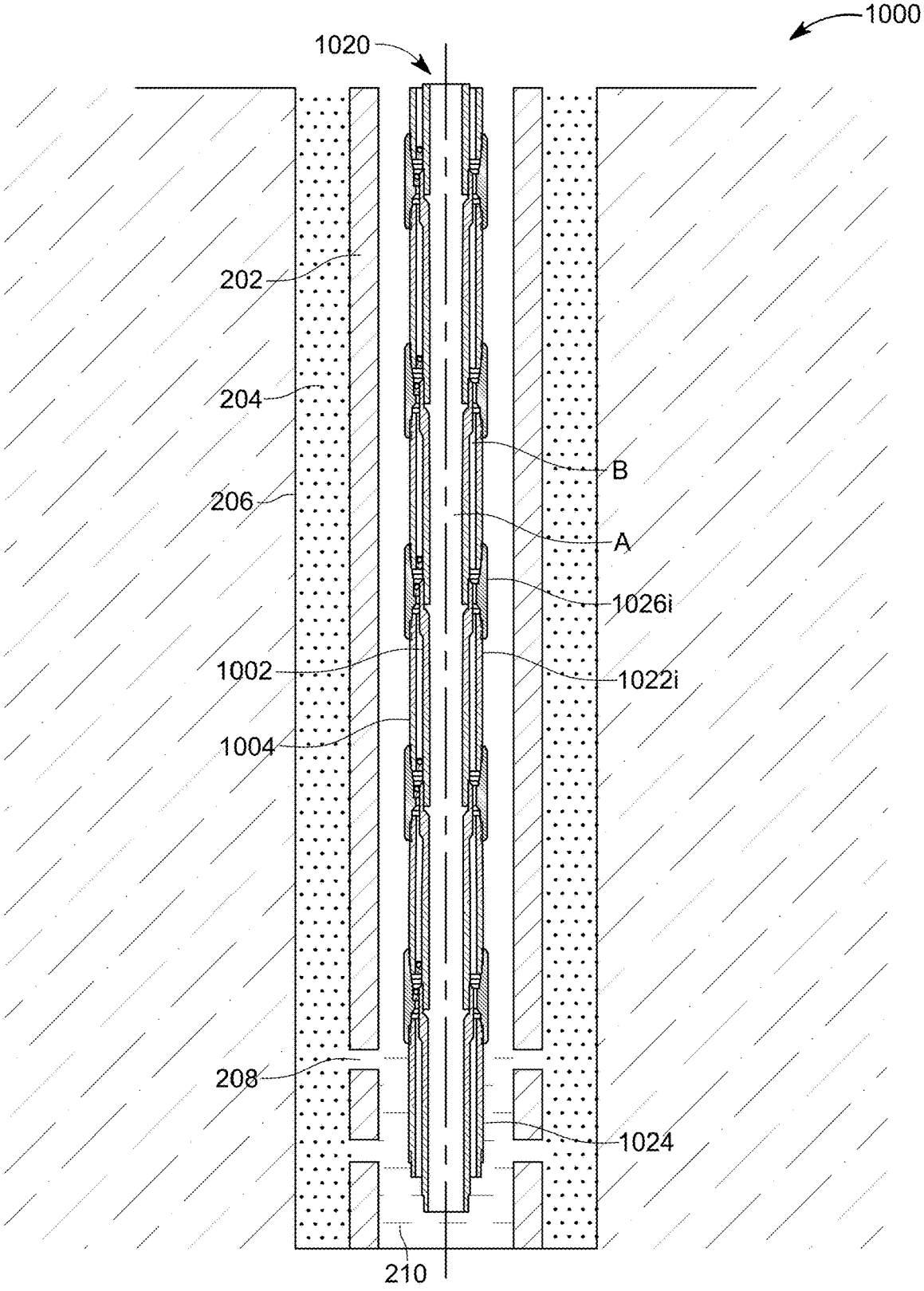
FIG. 10 shows a tubing system that uses plural joint tube elements and dual house connectors.

The dual simultaneous, direct, connection between two joint pipe elements 322 and 522, as discussed above, can also be achieved by using a connector part as now discussed. FIG. 10 shows an oil lifting system 1000 that includes a tubing system 1020 for artificial gas lifting. The tubing system 1020 includes plural joint pipe elements 1022*i*, connected to each other through corresponding connectors 1026*i*. The most distal element 1024, may be connected at its upstream end with the same connector 1026*i*, while its downstream end may have no connection, as will be discussed later. Each of the joint pipe element 1022*i* has an inner pipe and an outer pipe similar to the joint pipe element 332 shown in FIG. 3. When the joint pipe elements 1022*i* and the connectors 1026*i* are all connected to each other, they form an inner tubular string 1002 and an outer tubular string 1004. The inner tubular string 1002 has a continuous bore A, which is called herein annulus A, and the outer tubular string 1004 forms an annulus B with the inner tubular string 1002. The pressure in each of the tubular string can be controlled independent of the other tubular strings.

Figure 11:
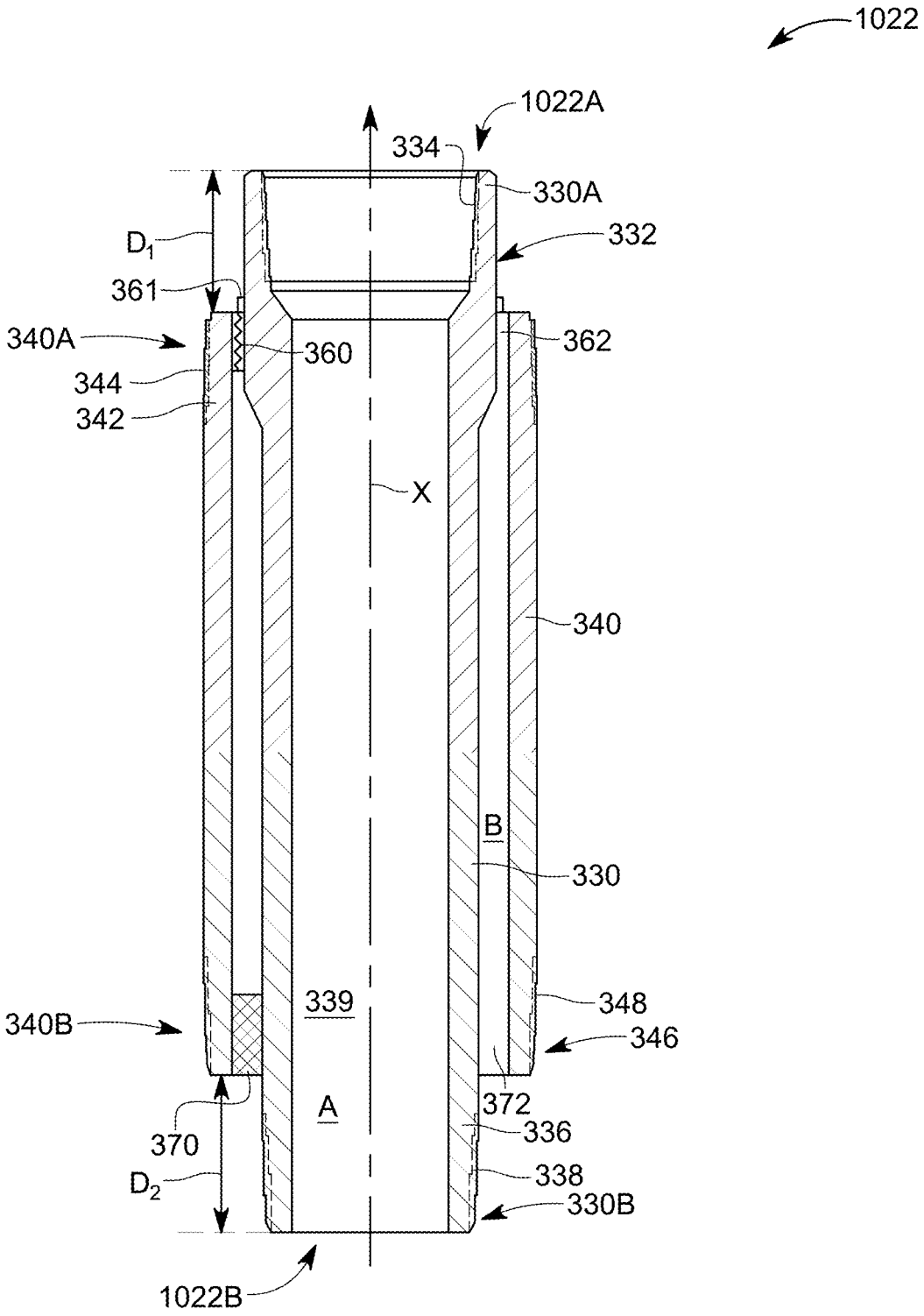
FIG. 11 shows a joint tube element having inner and outer pipes configured to be connected to a connector.

A joint pipe element 1022 that is configured to connect to a connector 1026 is now discussed with regard to FIG. 11. The joint pipe element 1022 includes, similar to the joint pipe element 322 of FIG. 3, an inner pipe 330 and an outer part 340. The downstream end 10226 of the joint pipe element 1022 is identical to the downstream end of the joint pipe element 322, and thus, the description of the elements of this end is omitted.

However, the upstream end 1022A of the joint pipe element 1022 is modified relative to the upstream end of the joint pipe element 322, as now discussed. These modifications are made to accommodate the connector 1026. More specifically, the inner pipe 330 has the upstream end 330A shaped as an inner tubular box 332 that has internal threads 334. The top most part of the inner tubular box 332 is offset by a distance D1 relative to the top most part of the outer pipe 340, along the longitudinal axis X. The outer pipe 340 has the upstream end 340A shaped as an outer tubular pin 342 with external threads 344. The inner tubular box 332 is leading the outer tubular pin 342 along the longitudinal axis X. Similarly, the inner tubular pin 336 of the inner pipe 330 is offset by a distance D2 from the outer tubular pin 346 of the outer pipe 340. However, for the downstream end, the outer tubular pin 346 is leading the inner tubular pin 336 along the longitudinal axis X. Similar to the joint pipe element 322, the distances D1 and D2 may be the same or different or zero.

The upstream lugs 360 located at the upstream end of the joint pipe element 1022 may be optional as a corresponding connector 1026 may achieve their functionality. However, if used, the upstream lugs 360 are attached (e.g., welded) to the outer pipe and the inner pipe may have a shoulder 361 that contacts the lug 360 and prevents the inner pipe to further move inside the outer pipe. The downstream lugs 370 located at the downstream end of the joint pipe element 1022 are similar to those of the joint pipe element 322.

Figure 12:
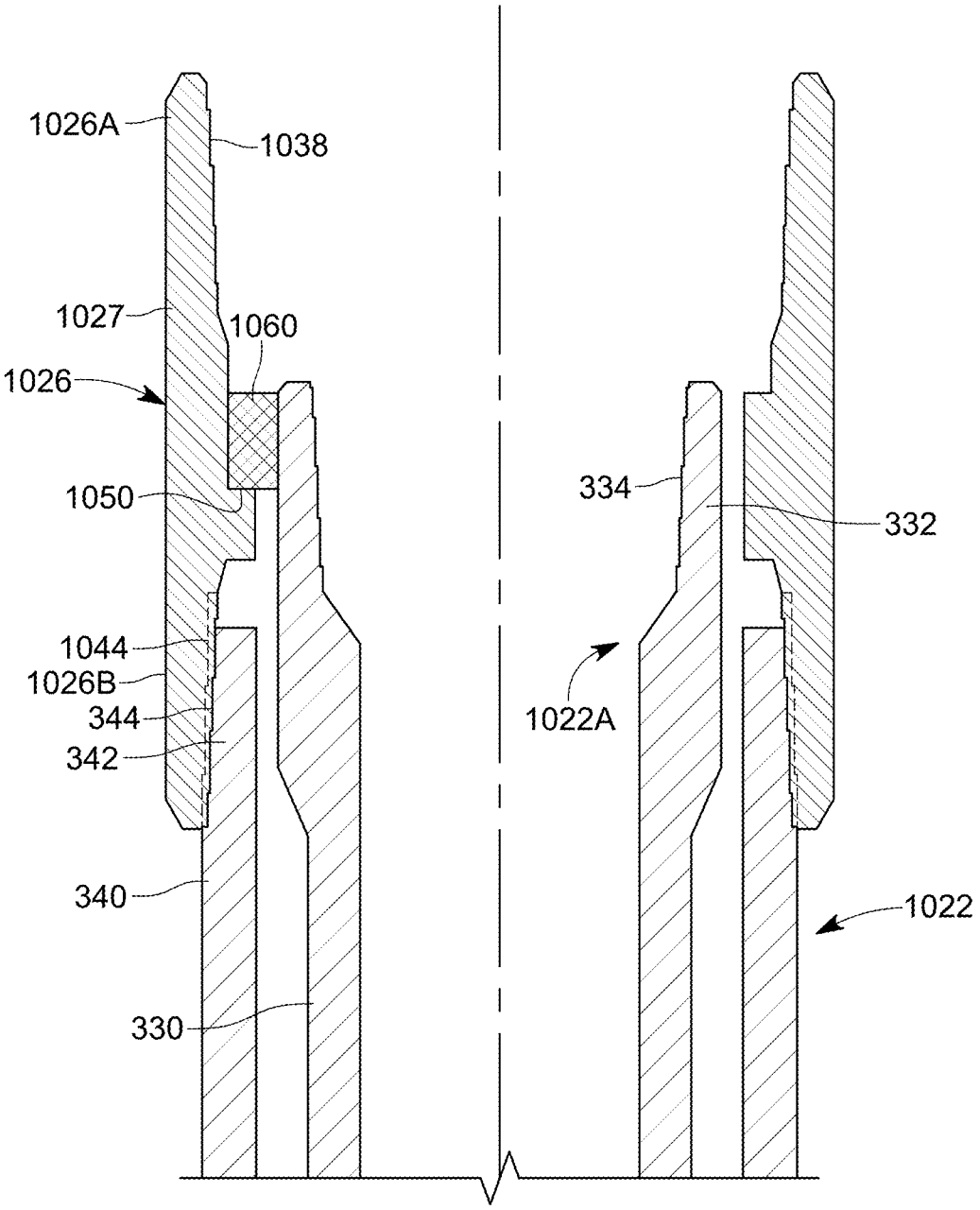
FIG. 12 shows an upstream end of a joint pipe element attached to a connector.

The connector 1026 is shown in FIG. 12 being attached to the upstream end 1022A of the joint pipe element 1022. The connector 1026 has a body 1027, which has an upstream part 1026A that is shaped as a tubular box and has inner threads 1038 that mate with the outer treads 338 of the outer pipe 340 of another joint pipe element (not shown). The connector body 1027 also has a downstream part 1026B that is shaped as a tubular box and has inner treads 1044 that mate with the outer threads 344 of the outer pipe 340 of the joint pipe element 1022.

Figure 13:
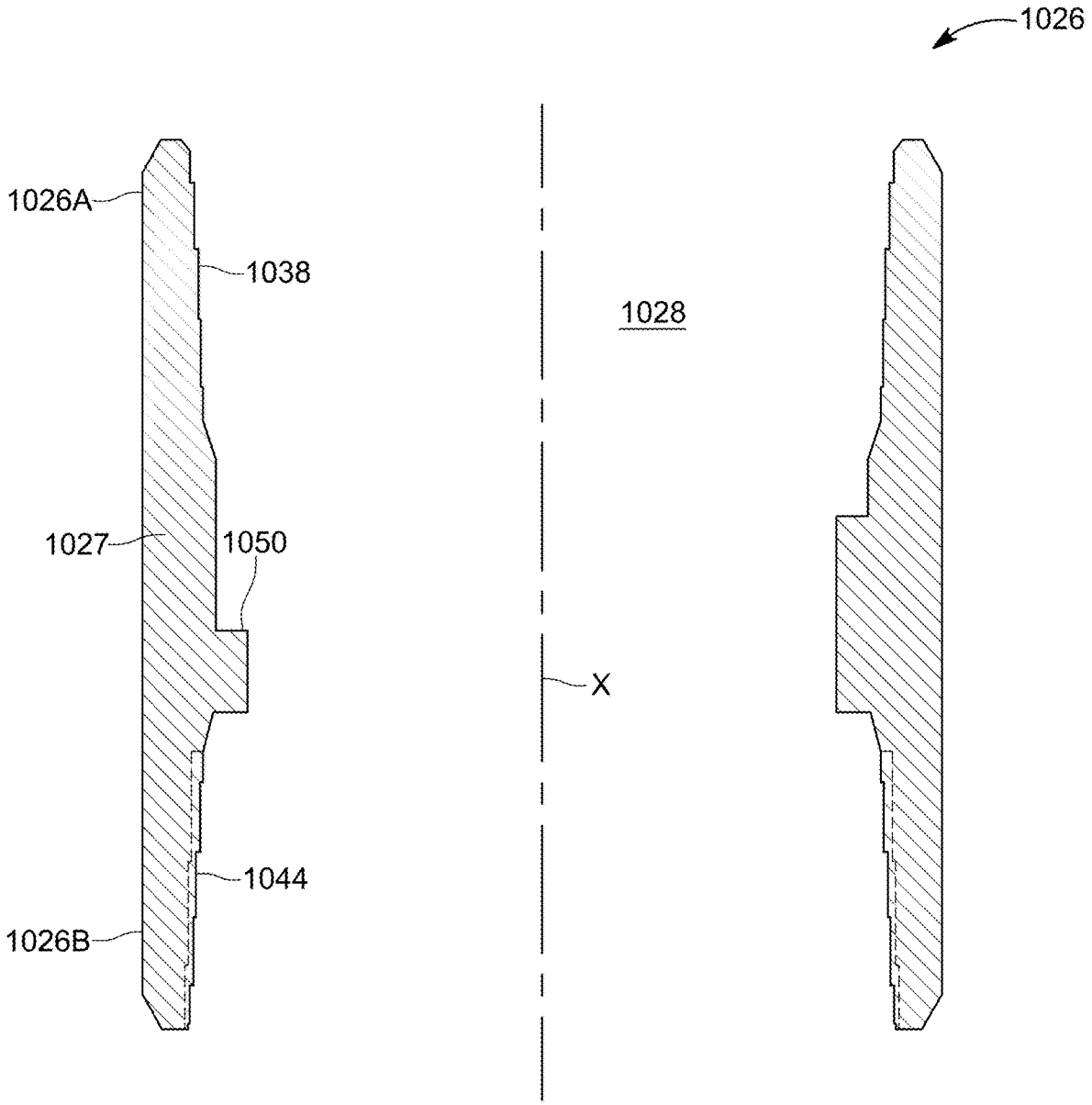
FIG. 13 shows a single house connector.

The connector 1026 is shown by itself in FIG. 13 in cross-section. It is noted that in this embodiment, there are grooves 1050 for receiving a corresponding lug. FIG. 13 shows a single groove 1050, but can be as many grooves as the number of lugs 1060 (shown in FIG. 12) attached to the inner pipe of the joint pipe element. The groove 1050 extends in this embodiment into the bore 1028 of the connector 1026. While FIGS. 12 and 13 show the connector 1026 connecting to each other only the outer pipes of two joint pipe elements (note that the inner pipes of the joint pipe elements connect directly to each other in this embodiment), in another embodiment it is possible to have a modified connector 1026 that connects only the inner pipes of the joint pipe element 1022 and the joint pipe element 1522. For this modified embodiment, which is shown in more details in FIG. 15B, the outer pipe of one joint pipe element connects directly to the outer pipe of the other joint pipe element.

Figure 14:
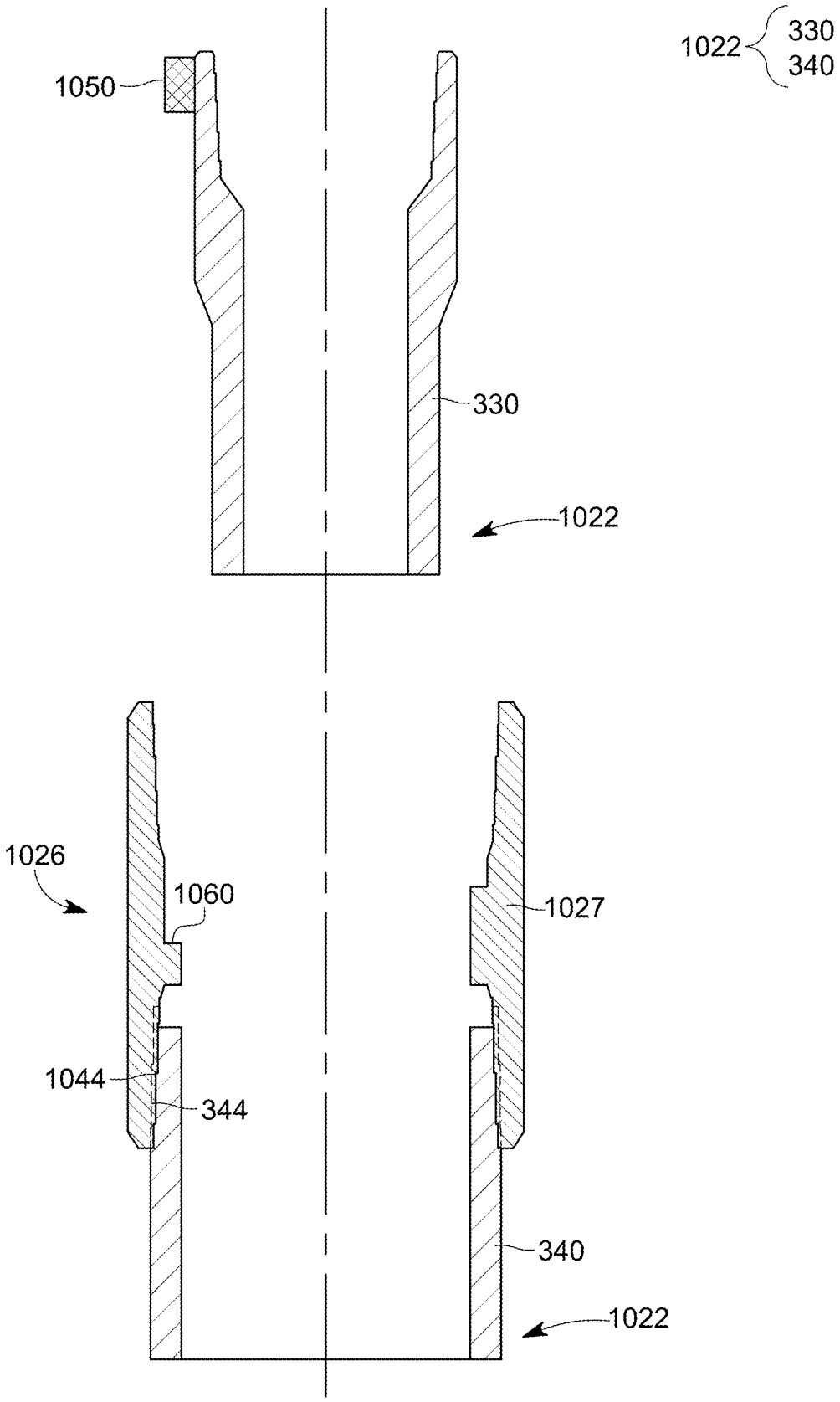
FIG. 14 shows how the inner pipe is added to the outer pipe for forming the joint pipe element.
Figure 15A:
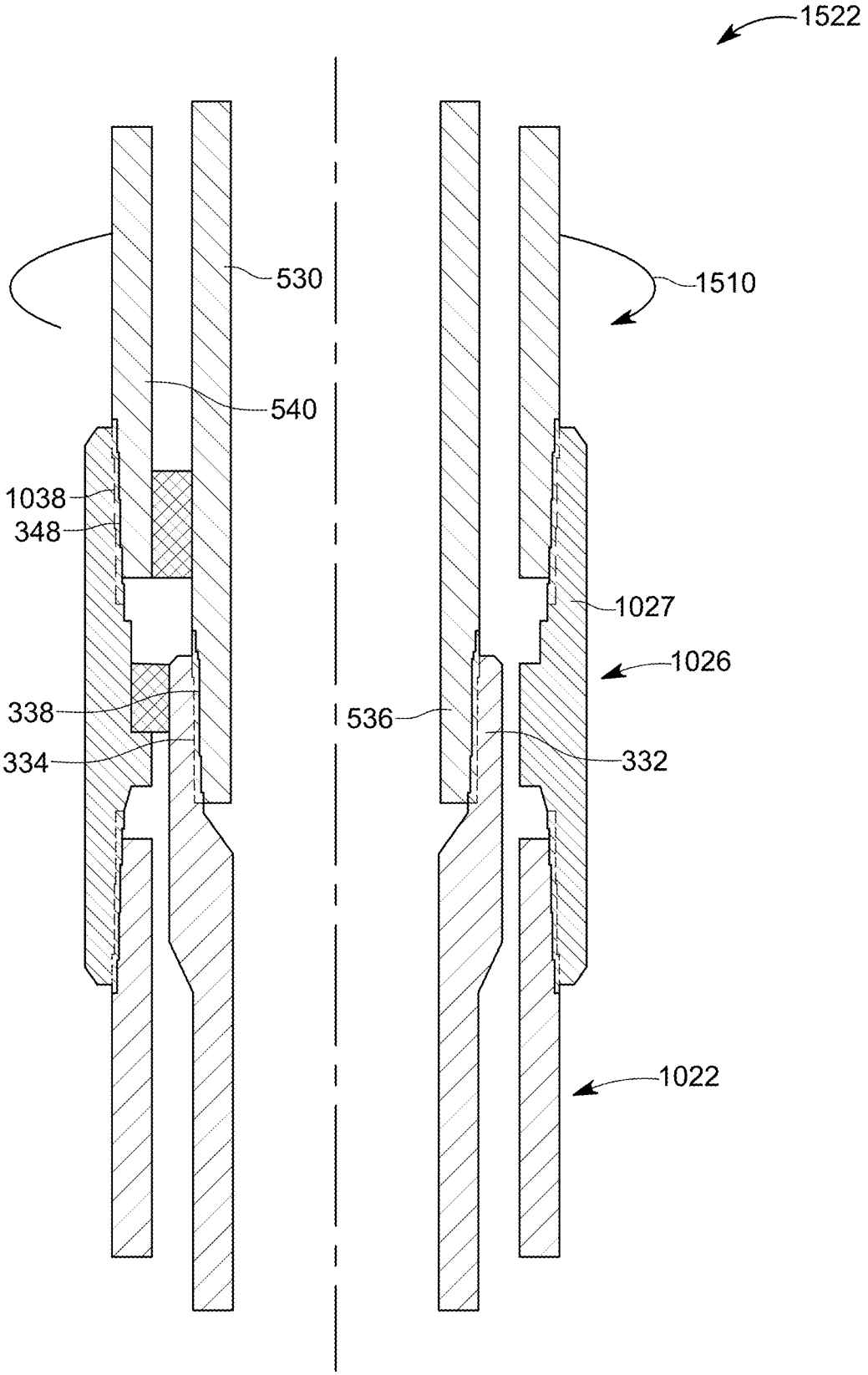
FIG. 15A shows a connector connecting only the outer pipes of two joint pipe elements.
Figure 15B:
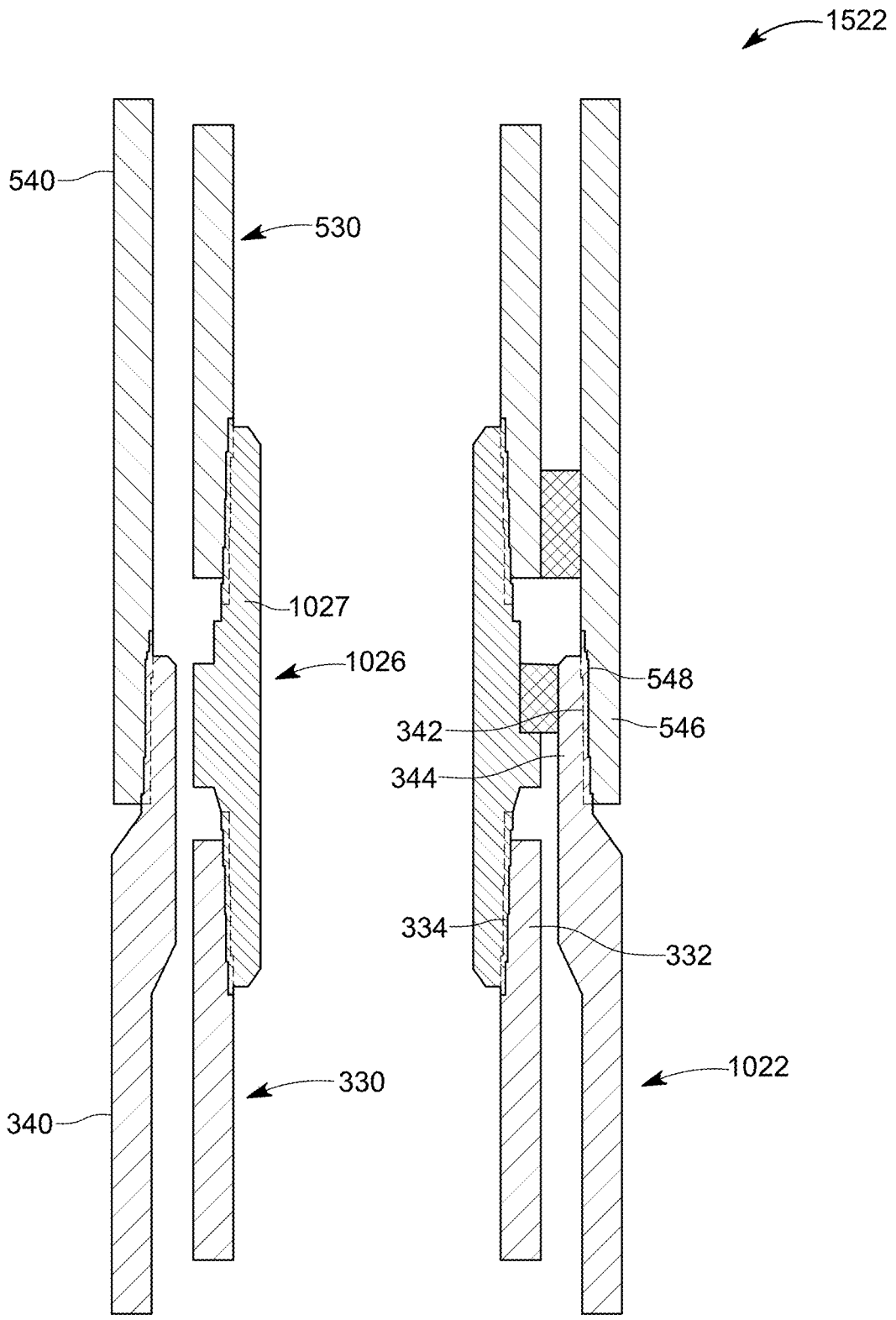
FIG. 15B shows a connector connecting only the inner pipes of two joint pipe elements while the connector is located in an annulus A.

FIG. 14 shows that to attach a connector 1026 to an end (the upstream end in this embodiment) of the joint pipe element 1022, first the outer pipe 340 is screwed into one end of the connector 1026 so that the threads 344 of the outer pipe engage the threads 1044 of the connector. Then, the inner pipe 330 is lowered into the outer pipe 340, with the inner pipe 330 having the lugs 1050 welded to its outside surface. After the lugs 1050 are pressed to contact the corresponding shoulders 1060 of the connector 1026, the joint pipe element 1022 is fully connected to the connector 1026, as illustrated in FIG. 12. Note that this operation may be performed at a site different from the well site, and at the well site, each joint pipe element has already been attached to a corresponding connector. Thus, when the time comes to built up the tubing system 1020, a joint pipe element 1522 is simply attached with a single rotational motion 1510 to another pipe element 1022, that already has the connector 1026 attached to its upstream end, as illustrated in FIG. 15A. In this way, the thread pairs (1) 1038 and 348 and (2) 334 and 338 are simultaneously engaged to each other with one single operation. Note that FIG. 15A shows the downstream joint pipe element 1022 having an inner tubular box 332 and the upstream joint pipe element 1522 having an inner tubular pin 536. The joint pipe element 1522 has an inner pipe 530 and an outer pipe 540. However, it is also possible that the downstream joint pipe element 1022 has an inner tubular pin 332 and the upstream joint pipe element 1522 has an inner tubular box 536. FIG. 15B shows an embodiment in which the connector 1026 is placed inside the inner pipes of the two joint pipe elements, so that the outer pipes connect directly to each other and the inner pipes connect through the connector to each other.

Figure 16:
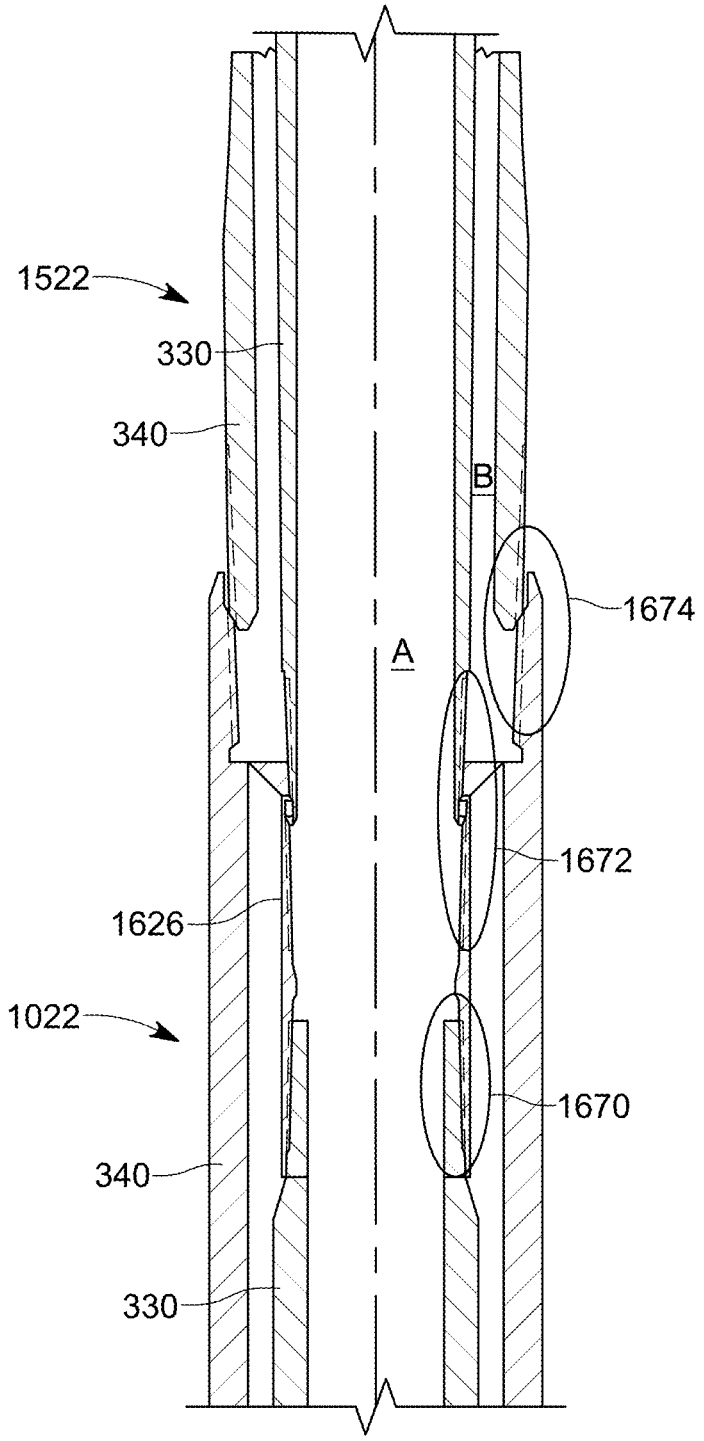
FIG. 16 shows a connector being attached to inner pipes of two joint pipe elements while the connector is located in an annulus B.

The embodiments discussed above with regard to FIGS. 10-15B have used a connector 1026 that connects only the outer pipes of the joint pipe elements while the inner pipes of the joint pipe elements directly connect to each other, or connects only the inner pipes of the joint pipe elements while the outer pipes directly connect to each other. For the later case, the connector was shown to be located inside annulus A. However, as illustrated in FIG. 16, it is possible to configure a connector 1626 that connects only the inner pipes of two joint pipe elements and the outer pipes directly connect to each other and the connector is located in annulus B. FIG. 16 shows the connector 1626 being fully located inside the outer pipes 340 of the joint pipe elements 1022 and 1522. The connector 1626 connects only the upstream end of the inner pipe 330 of the joint pipe element 1022 to the downstream end of the inner pipe 330 of the joint pipe element 1522, as indicated by zones 1670 and 1672, and this connection is achieved with threads. The upstream end of the outer pipe 340 of the joint pipe element 1022 is directly connected to the downstream end of the outer pipe 340 of the joint pipe element 1522, as indicated by zone 1674, and this connection is also achieved with threads. As for the previous embodiments, the threads at zones 1670 and 1672 are engaged simultaneously. Note that in this embodiment, the body of the connector 1626 is located in annulus B, and not in annulus A as in FIG. 15B.

Figure 17:
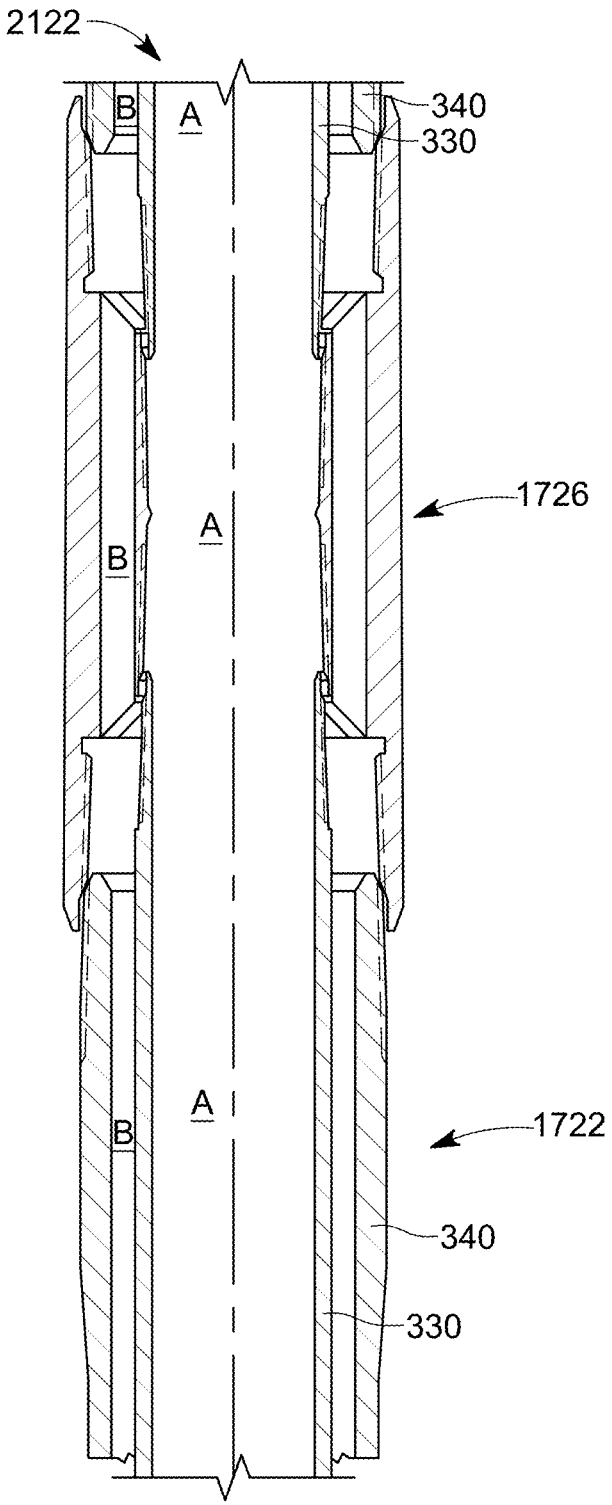
FIG. 17 shows a double house connector being attached to two joint pipe elements.
Figure 18:
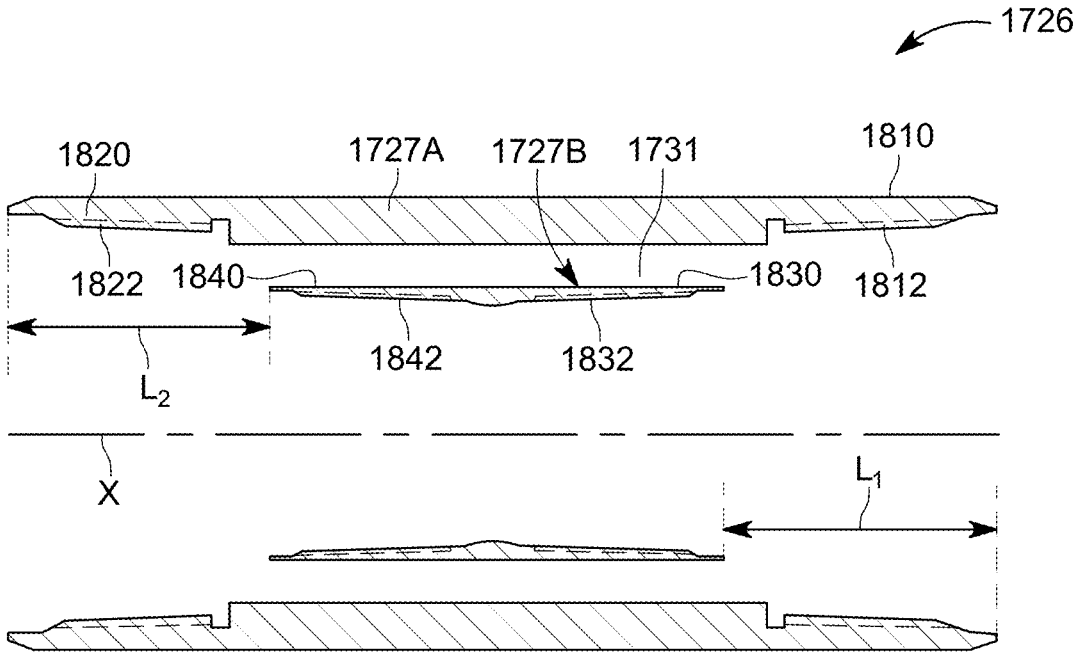
FIG. 18 shows the connector having the dual house.
Figure 19:
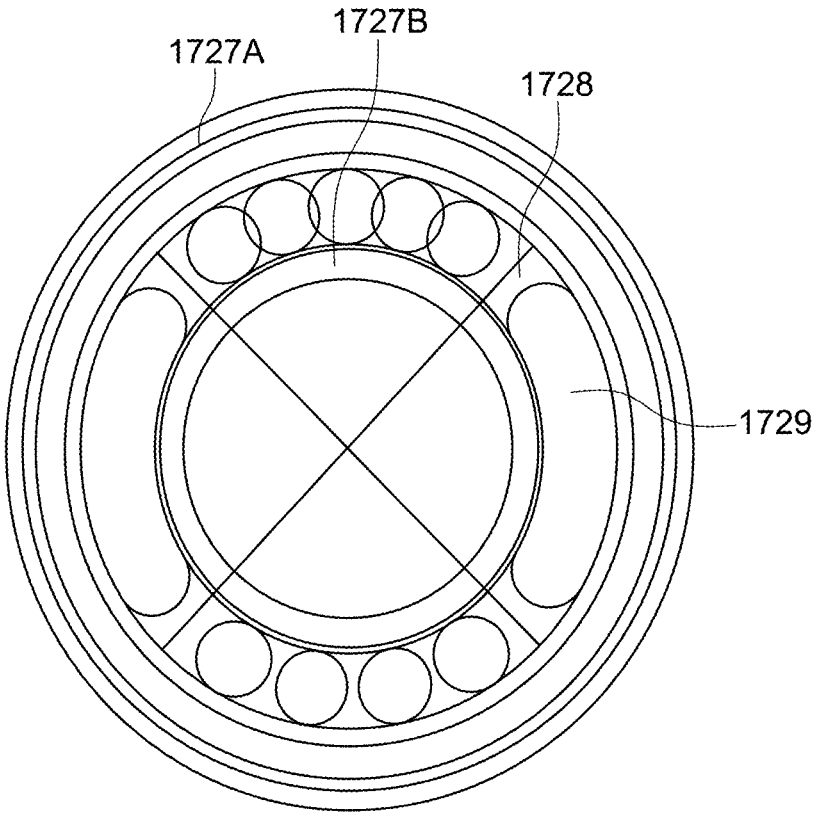
FIG. 19 shows a cross-section of the dual house connector.

In still another embodiment, as illustrated in FIG. 17, the connector 1726 is configured to connect both the inner pipes and the outer pipes of the joint pipe elements 1722 and 2122 to each other, to form the annulus A and the annulus B. FIG. 18 shows a cross-section through the connector 1726. The connector 1726 has an outer body 1727A that connects the outer pipes of the joint pipe elements and an inner body 1727B that connects the inner pipes of the joint pipe elements. The inner body 1727B is located inside a bore 1731 of the outer body 1727A and is attached to the outer body 1727A, as shown in FIG. 19, by one or more bridges 1728. Holes or slots 1729 or both are formed between the two bodies and the bridges for allowing the fluid in annulus B to move from one joint pipe element to another one. In one embodiment, the two bodies 1727A and 1727B are made of a same piece of material, i.e., they are an integral body.

Returning to FIG. 18, the outer body 1727A has an upstream tubular box 1810 that has inner threads 1812 and has a downstream tubular box 1820 that has inner threads 1822. The inner threads 1812 and 1822 are configured to engage the corresponding threads of the outer pipes of the joint pipe elements or a joint pipe element and one of a tool or production tubing. The inner body 1727B has an upstream tubular box 1830 that has inner threads 1832 and has a downstream tubular box 1840 that has inner threads 1842. The inner threads 1832 and 1842 are configured to engage the corresponding threads of the inner pipes of the joint pipe elements. In this embodiment, the inner tubular boxes 1830 and 1840 are offset inside the housing relative to their outer counterparts 1810 and 1820 along the longitudinal X axis. More specifically, in this embodiment, the inner tubular boxes 1830 and 1840 are recessed from the outer tubular boxes 1810 and 1820, respectively, by distanced L1 and L2, as illustrated in FIG. 18. Distances L1 and L2 may be the same or different or even zero.

Figure 20:
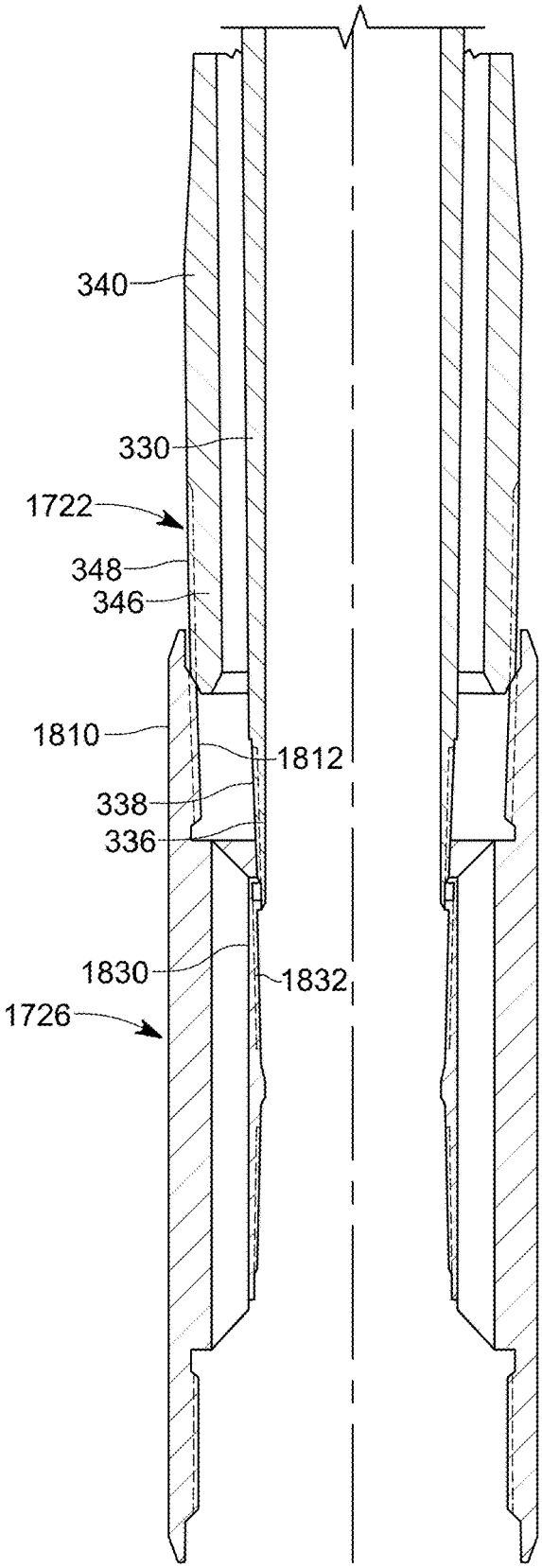
FIG. 20 shows a joint pipe element engaging the connector.
Figure 21:
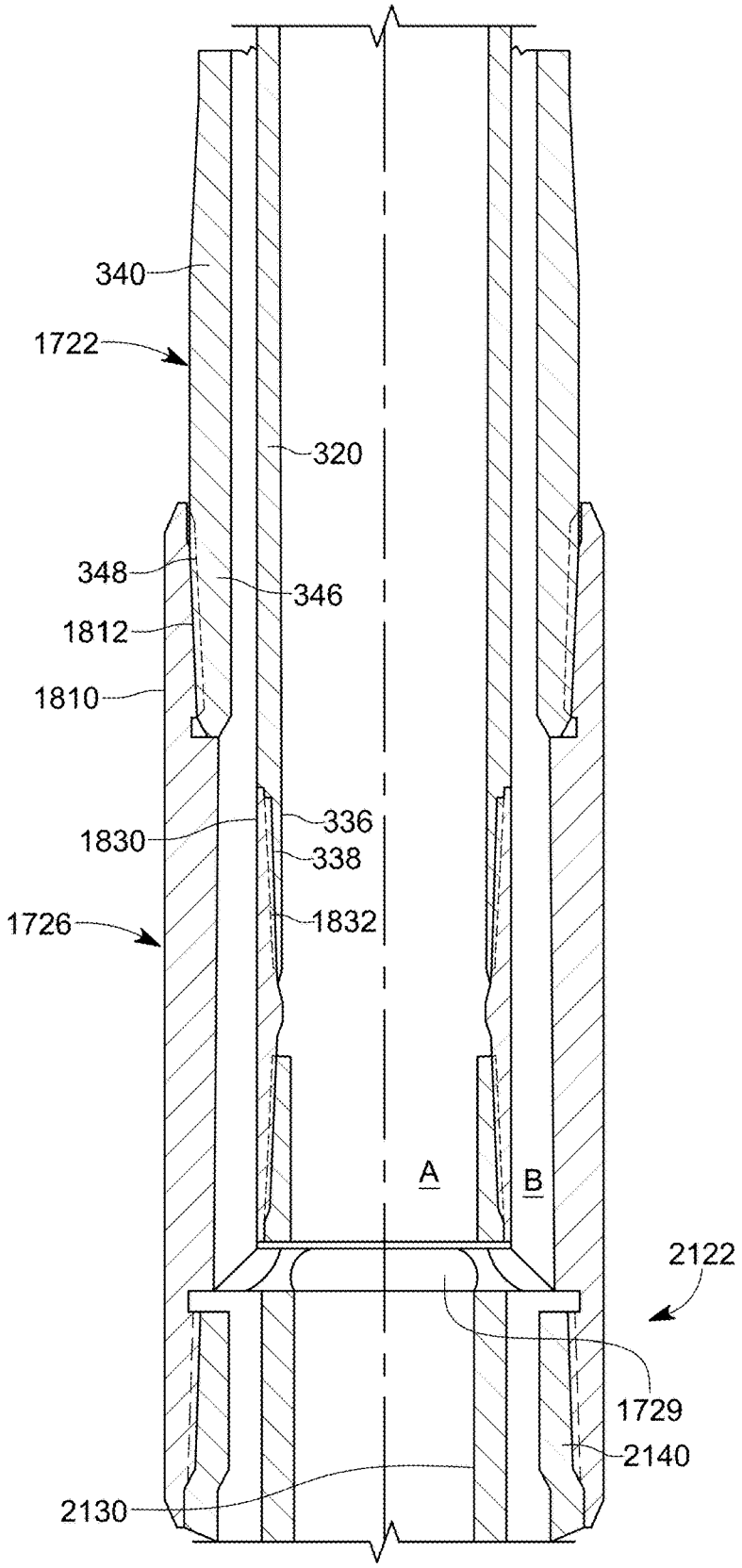
FIG. 21 shows two joint pipe elements engaged with the connector.

FIG. 20 shows how the joint pipe element 1722 is brought into contact with the connector 1726 so that both the outer threads 348 of the outer tubular pin 346 and the outer threads 338 of the inner tubular pin 336 are simultaneously engaging the corresponding inner threads 1812 of the outer tubular box 1810 of the connector 1726 and the inner threads 1832 of the inner tubular box 1830 of the connector 1726, respectively. After the joint pipe element 1722 is rotated one or more times (or even a fraction of one full turn), these threads are fully engaged with each other as illustrated in FIG. 21. FIG. 21 also shows that another joint pipe element 2122, having inner pipe 2130 and outer pipe 2140, has been attached to the other end of the connector. It is noted that the inner pipe cannot rotate relative to the outer pipe for any of the joint pipe elements discussed herein so that the torque applied to the outer pipe of a joint pipe element is conveyed though the lugs to the inner pipe, thus insuring that all threads in the joint pipe element are sufficiently tightened.

The embodiments discussed above described a joint pipe element that can be connected either directly to another joint pipe element or indirectly, through a connector, to another joint pipe element. The inner and outer pipes of such joint pipe element may be made of a same material (e.g., a metal, a composite, etc.) or from different materials. The number of teeth of the threads of the inner and outer pipes and the connector are identical so that when one joint pipe element is rotated to another joint pipe element or to the connector, both the inner and outer pipes are engaging with the corresponding inner and outer pipes of the other element or connector. The inner and outer pipes of the above discussed joint pipe elements were shown to be concentric and they can be installed in vertical or horizontal wells. They can be installed with a packer or with no packer.

Plural joint pipe elements connected to each other form the tubing system, which can be seen as including an inner tubular string formed from all the inner pipes of the joint pipe elements, and an outer tubular string formed from all the outer pipes of the joint pipe elements. The tubing system may be used to install production and/or work-over concentric U-tube capability to any depth of the well bore.

In one application, a secondary resilient thread seal ring may be added to one or more of the machined threaded inner and/or outer pipes (see, for example, FIG. 8) to insure pressure integrity of the threaded connections during the simultaneous torqueing of each of the inner and outer tubular strings. This seal ring may be positioned in a groove (see element 812 or 822 in FIG. 8) machined into the thread connection profile prior to installation into the well.

In another application, one or more of the joint pipe elements may use an additional "metal to metal" seal. In one variation, a joint pipe element may have the inner tubular string connected by a stab-in seal pin assembly and a corresponding internal seal bore member, as illustrated in FIG. 9. The joint pipe element may have three or more similarly constructed pipes that are installed in a well casing as one unit, creating a multiple of pressure autonomous conduits.

In one embodiment, a joint pipe element may be modified to house a well servicing receiver device such as gas lift mandrels, sliding sleeves and ported landing nipples. These tubular well servicing devices can be physically joined and ported to one or more of the flow areas between the inner pipe and the other conduits in the well, including the well casing and the outer string annulus. Well servicing tools can be installed through the inner pipe of the joint pipe element by using wireline or coiled tubing or they can be pumped down into the inner pipe of the joint pipe element to selectively either block off or control pressure, fluid or gas passage between two or more of the conduits. The tubular well servicing receiver devices may have larger outside diameters (ODs) than the internal diameter (ID) of the surrounding conduit. If this is the case, both can be increased to accommodate the larger OD device and still conform to the concentric end connection profiles of the tubular system and maintain the continuous separate pressure conduits.

The joint pipe elements of the embodiments discussed herein can be installed in a well in which a single tubing string extends from the surface to a hanger nipple with an inner sting continuation of the upper tubing string and an additional outer concentric tubing string extending through a casing/outer tubular packer device. The outer tube can be ported above the packer to allow the casing anulus to connect to the outer and inner pipes of the joint pipe element extended through the packer to provide for production or well servicing devices to any depth of the well in either vertical or horizontal oriented wellbores.

The disclosed joint pipe elements, when attached to the outer and inner tubular strings of a continuous flow venting chamber pump and installed into a well bore, to any desired depth, provide for gas lift capability for producing fluid/gas from an oil well from initial completion to tertiary condition-life of the well production, in either vertical or horizontal wells. This installation could be run with or without a casing packer.

In one application, the joint pipe element can be combined with a hydraulic reciprocating piston pump, or with a hydraulic venturi "jet" piston pump, or with a hydraulic turbine pump, or with a electrical submersible pump (ESP) to provide for producing fluid/gas from a well bore. In another application, the joint pipe elements discussed herein can be combined with a hydraulic reciprocating piston or hydraulic "jet" pump or electrical submersible pump to produce fluid/gas from a well bore, utilizing gas lift to reduce the discharge pressures of the pump to increase production.

In still another application, the plural joint pipe elements may be installed below a single tubing string with a ported inlet device to provide communication from the casing conduit to the B annular conduit above a packer device, which isolates the upper casing area from the lower casing area. This extends the casing conduit to the lower part of the well providing artificial lift deeper in the well bore.

In yet another application, the plural joint pipe elements may be connected upward to a well head landing bowl and made to be compatible with a casing hangar to provide for well head connections to surface conduits for each of the joint pipe element inner string flow area and outer/inner annular flow areas and a separate casing annular flow area.

Figure 22:
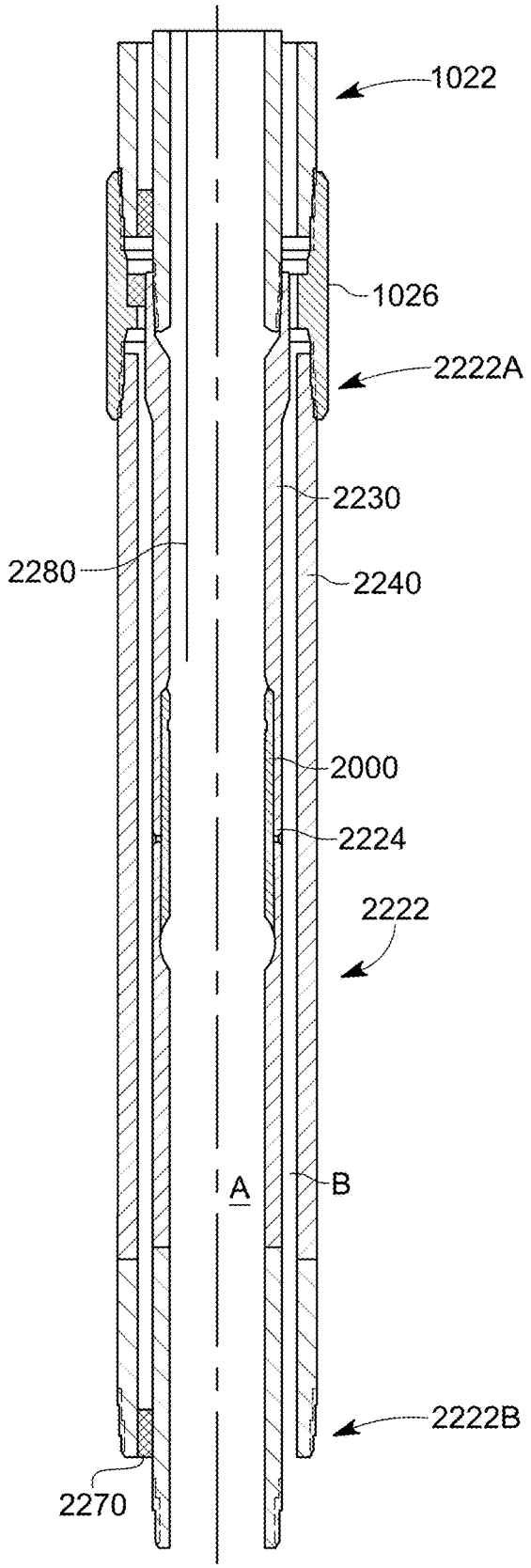
FIG. 22 shows a well servicing tool that is configured to be attached to a joint pipe element.

Various well servicing tools that can be used with the joint pipe element are now discussed in more detail. FIG. 22 shows a first such well servicing tool. The well servicing tool 2222 includes an oil extracting instrument (e.g., a sleeve) 2000 that is installed in the inner pipe 2230. The well servicing tool 2222 has, in addition to the inner pipe 2230, an outer pipe 2240 that encloses the inner pipe 2230, and one or more lugs that attaches the inner pipe to the outer pipe and make the two pipes to act as a single unit when a torque is applied to the outer pipe, as previously discussed with regard to joint pipe elements 322 and 1022. The upstream end 2222A of the well servicing tool 2222 has the same structure as a joint pipe element 1022 so that is can connect, via connector 1026, in a single rotational movement, to a joint pipe element 1022, as illustrated in FIG. 22. However, the downstream end 2222B of the well servicing tool 2222 may be different from a downstream end of the joint pipe element 1022 as there are no threads for connecting to another joint pipe element. This is so because the downstream end 2222B of the well servicing tool 2222 is supposed to be open to the oil present inside the casing. However, in one application, the downstream end 2222B of the well servicing tool may be configured to be identical to the downstream end of the joint pipe element 1022, if it desired to interconnect the well servicing tool 2000 between two different joint pipe elements.

The sleeve 2000 is configured to slide up and down along the inner pipe 2230 so that it can open and close a passage 2224 formed between the bore of the inner pipe 2230 and an annulus B formed between the inner pipe 2230 and the outer pipe 2240, i.e., between annulus A and annulus B. In one application, the sliding sleeve 2000 can be opened and closed with a wireline line 2280 that is run from the head of the well. The wireline line 2280 is run into the well until an end of it latches to the sleeve 2000 and then the sleeve can be opened or closed with the wireline line. In this way, fluid communication may be achieved between annulus A and annulus B so that the oil can be lifted to the surface. In one application, a gas is pumped from the surface through annulus B and then enters the annulus A though the passage 2224, which results in a hydrostatic pressure above the oil being reduced. In this way, the oil that enters the downstream end 2222B is moved toward the surface along annulus A.

Figure 23:
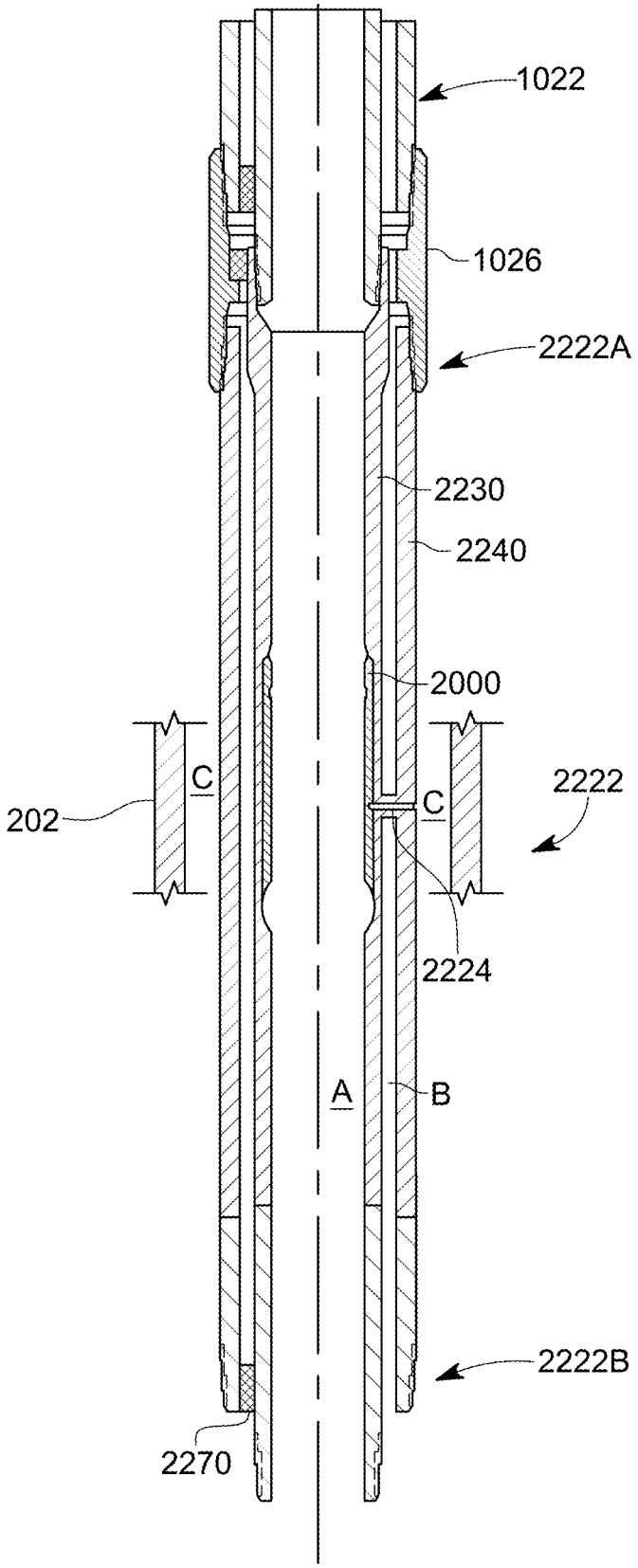
FIG. 23 shows a well servicing tool that is configured to be attached to a joint pipe element through a connector.

The well servicing tool 2222 may be modified as shown in FIG. 23, so that the passage 2224 is now formed between the annulus A and the annulus C, which is formed between the casing 202 and the outer pipe 2240. In this embodiment, there is no fluid communication, through the passage 2224, between the annulus A and the annulus B. In both embodiments, plural lugs 2270 may be located, at the downstream end of the well servicing tool, for centering the inner pipe relative to the outer pipe, similar to the joint pipe element 322 or 1022.

Figure 24:
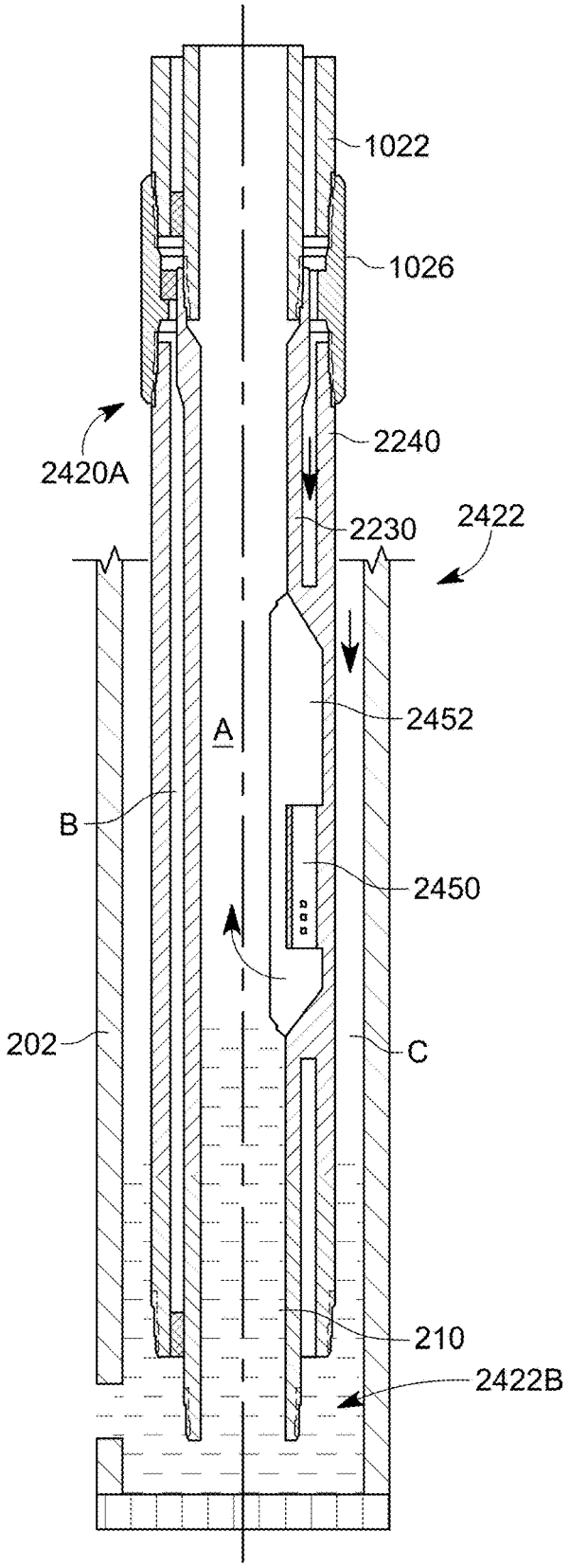
FIG. 24 shows a gas lifting device configured to be attached to a connector or joint pipe element.

Another well servicing tool 2422 is shown in FIG. 24 and this tool includes another oil extracting instrument, a gas lift device 2450. The gas lift device 2450 (which includes a gas valve that allows the gas to pass through in one direction, but not the oil) is located in a side pocket 2452 formed in the inner pipe 2430. For this arrangement, the inner pipe 2430 and the outer pipe 2440 are not entirely concentric. As shown in the figure, the inner and outer pipes at the upstream end 2420A and at the downstream end 2420B of the well servicing tool are concentric, while the middle portion of the tool is not concentric. Note that for connecting the well servicing tool 2422 to the connector 1026, only the upstream end 2422A needs to be concentric. When in use, the well servicing tool 2422 may be placed with its downstream end 2422B at the toe of the well, close to the end of the casing 202. A gas is pumped from the head of the well along the annulus C. The gas enters through the gas lift device 2450 into annulus A and reduces the hydrostatic pressure experienced by the oil 210. In this way the oil 210 starts flowing to the surface along the annulus A.

If more than one well servicing tool 2450 are used in the same well for further reducing the hydrostatic pressure in the well, both ends of the tool are configured to be identical to the ends of the joint pipe element 1022 so that the upper placed well servicing tools 2450 can be connected at both ends to corresponding joint pipe elements and/or connectors, i.e., they are interconnected between joint pipe elements. The same is true for any well servicing tool discussed herein.

Figure 25:
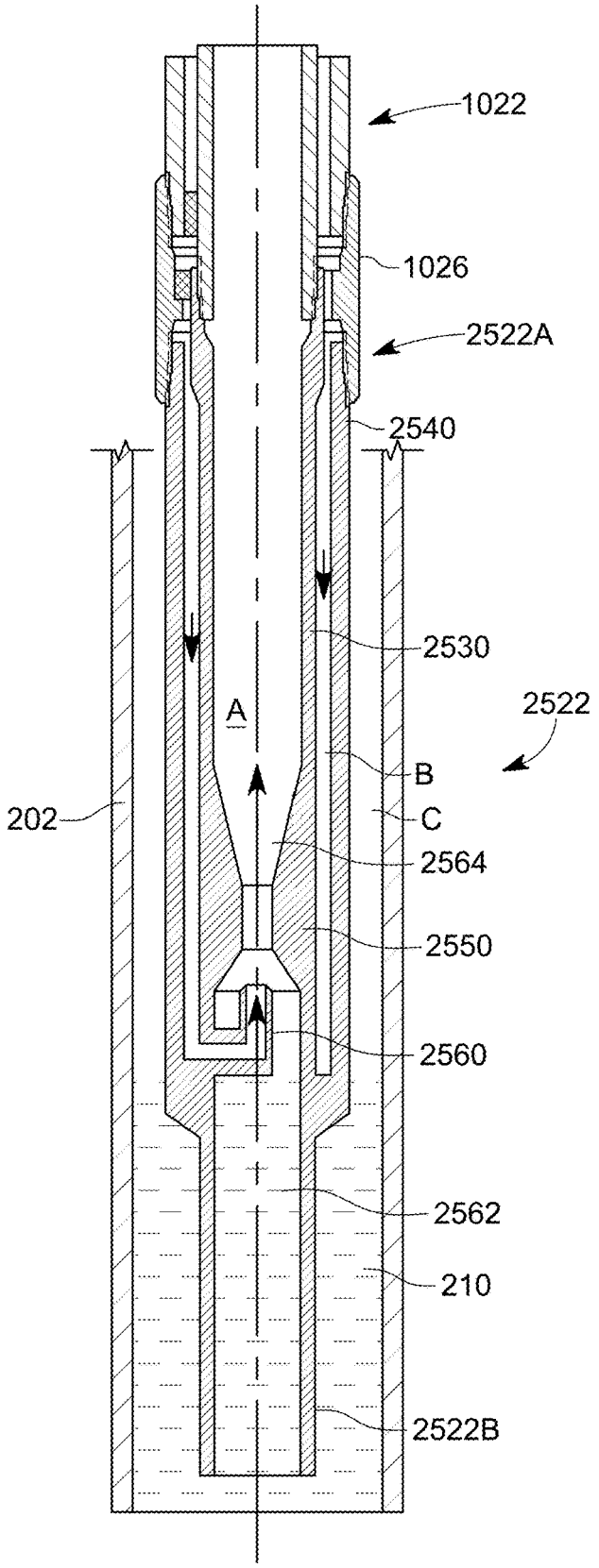
FIG. 25 shows a hydraulic lifting device configured to be attached to a connector or joint pipe element.

Another well servicing tool 2522 is shown in FIG. 25 and this tool includes still another oil extracting instrument, a hydraulic powered pump device 2550 that is configured to fluidly communicate with annulus A and annulus B. The top end 2522A of the well servicing tool 2522 is configured to be identical to the top part of any of the joint pipe element discussed herein, so that the well servicing tool 2522 can be connected, via connector 1026 or with no connector, by a single rotational movement, to a joint pipe element as discussed in the previous embodiments (e.g., 322 or 1022). In the embodiment shown in FIG. 25, the bottom end 2522B of the well servicing tool has no threads or other structures as this specific implementation of the tool is designed to be the first element (closest to the toe of the well) of the tubing system. However, if the well servicing tool 2522 is intended to be inserted between two joint pipe elements, then the downstream end 2522B may be configured to be identical to the downstream end of the previous joint pipe elements 322 or 1022, so that it can be connected to the upstream end of another joint pipe element.

When in use, gas is pumped from the surface along annulus B. The gas is directed through a passage 2560, into the annulus A. Because a cross-section area of the passage 2560 is smaller than that of annulus A, a pressure difference (Venturi effect) is formed between the region 2562 where the oil 210 is present, and the region 2564 above that region, and the oil moves upward due to the reduced pressure. Those skilled in the art would understand that any type of hydraulic powered pump may be integrated in the well servicing tool 2522, for example, a jet pump, hydraulic reciprocating piston pump, hydraulic turbine pump as long as a discharge pressure of the tool is smaller than the hydrostatic pressure of the column of fluid above the oil so that the oil production is increased.

Figure 26:
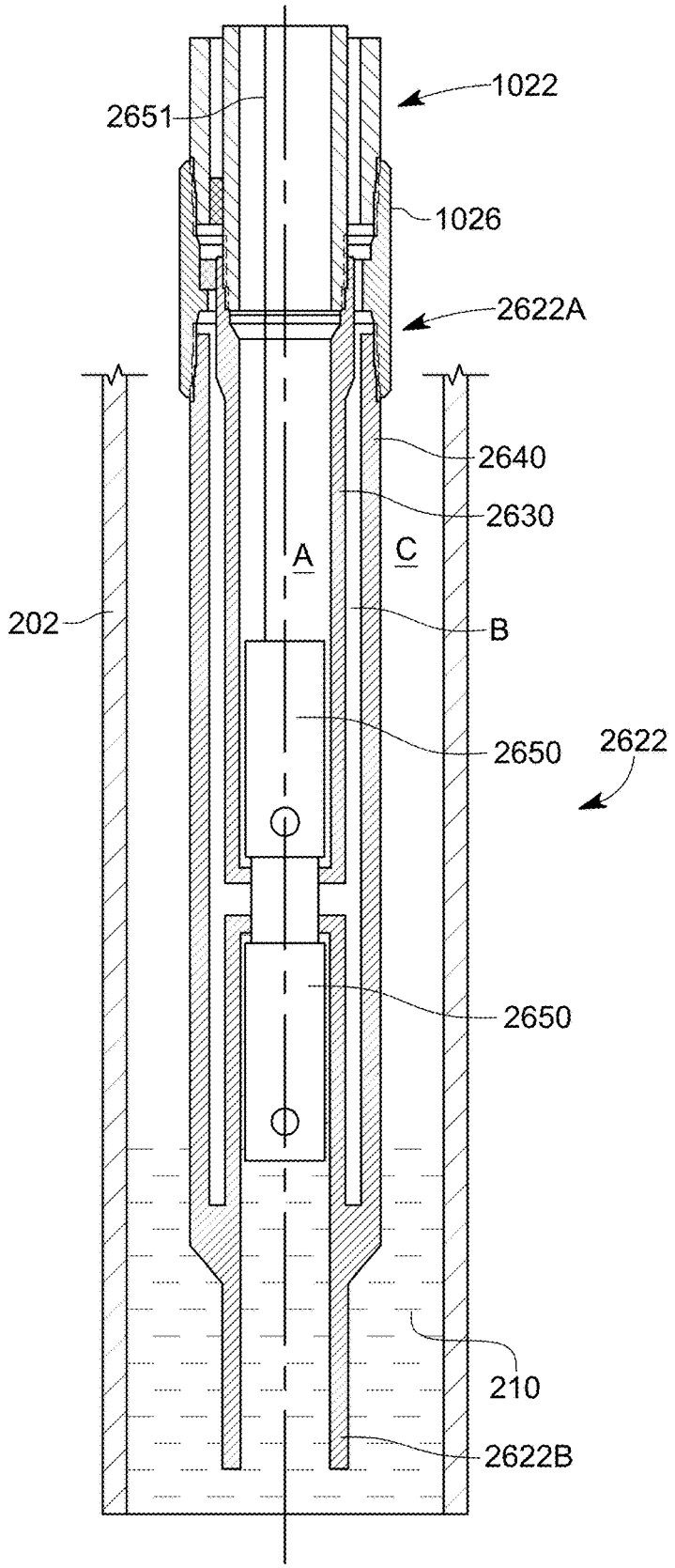
FIG. 26 shows a pump lifting device configured to be attached to a connector or joint pipe element.

In another embodiment illustrated in FIG. 26, a well servicing tool 2622 includes another oil extracting instrument, which includes one or more powered piston pumps 2650. The pump 2650 may be located inside the inner pipe 2630 and may be powered by a rod 2651 that extends from the head of the well. The upstream end 2622A of the well servicing tool 2622 is configured to be identical to the upstream end of the joint pipe element 322 or 1022 so that it can be connected, by a single rotational motion, to a corresponding joint pipe element or connector. The downstream end 2622B of the tool may also be configured to be identical to the downstream end of the joint pipe element 322 or 1022 so that the tool 2622 may be interconnected between joint pipe elements. However, it is also possible that the downstream end 2622B of the tool has no threads and no concentric pipes, as shown in FIG. 26, if the tool is the most distal element of the tubing system, i.e., the element that is closes to the toe of the well and is placed in the oil 210.

When in use, the rod 2651 is actuated to make the powered piston pump 2650 work, which creates a pressure above the pump that is smaller than the pressure below the pump. When this pressure difference is generated, the oil 210 below the pump starts to move upwards, toward the head of the well. More than one powered piston pumps may be located over the tubing system.

Figure 27:
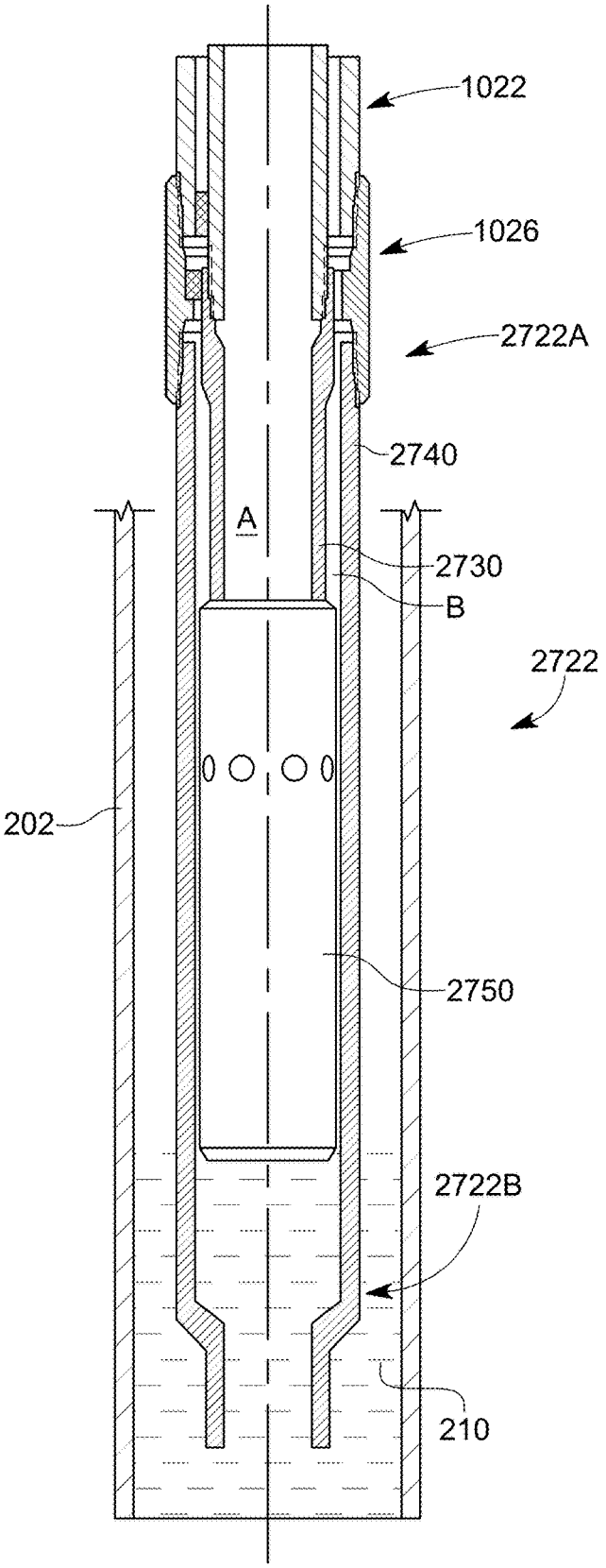
FIG. 27 shows an electrical submersible pump configured to be attached to a connector or joint pipe element.

In yet another embodiment illustrated in FIG. 27, a well servicing tool 2722 includes yet another oil extracting instrument, which includes one or more electric submersible pumps (ESP) 2750. The ESP pump 2750 may be located inside or connected to the inner pipe 2730 and may be powered with electrical power provided along a wire (not shown) that extends from the head of the well. In one embodiment, the wire is built into the wall of the inner pipe 2730 or the outer pipe 2740. The upstream end 2722A of the well servicing tool 2722 is configured to be identical to the upstream end of the joint pipe element 322 or 1022 so that it can be connected, by a single rotational motion, to a corresponding joint pipe element or to connector 1026. The downstream end 2722B of the tool may also be configured to be identical to the downstream end of the joint pipe element 322 or 1022 so that the tool 2722 may be interconnected between joint pipe elements. However, it is also possible that the downstream end 2722B of the tool has no threads and no concentric pipes, as shown in FIG. 27, if the tool is the most distal element of the tubing system, i.e., the element that is closest to the toe of the well and is placed in the oil 210.

When in use, electrical power is supplied to the ESP pump 2750, which creates a pressure above the pump that is smaller than the pressure below the pump. When this pressure difference is generated, the oil 210 below the pump starts to move upwards, toward the head of the well. More than one ESP pumps may be located over the tubing system.

Those skilled in the art would understand that the embodiments shown in FIGS. 22-27 illustrate only some possible implementations of a well servicing tool. Any well servicing tool that is capable of reducing a hydrostatic pressure above the oil 210 may be implemented with the concentric pipe endings that characterize the joint pipe elements 322 or 1022 so that the tool can be attached to the tubing system by a single rotational motion.

Figure 28:
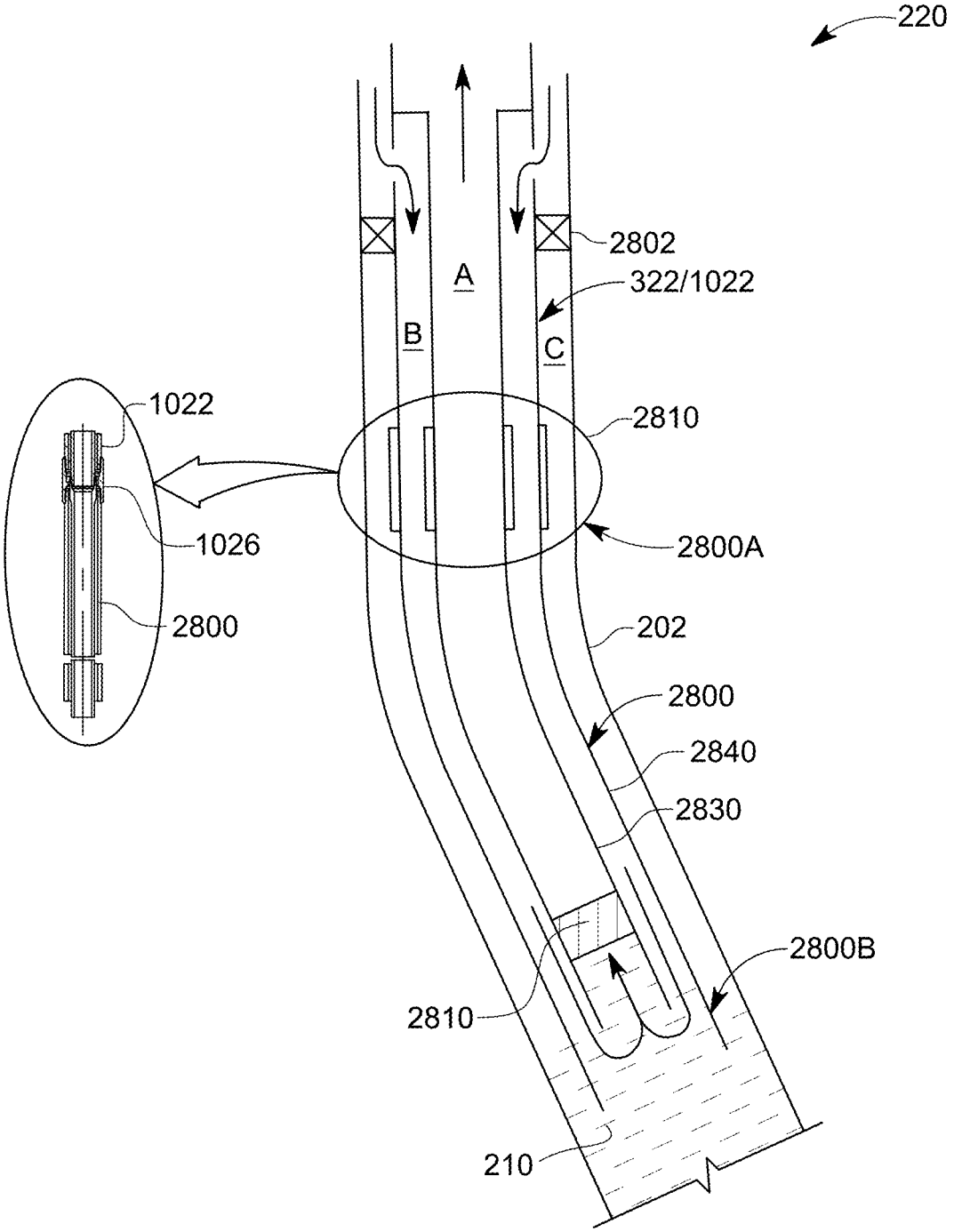
FIG. 28 shows a dip tube production tool configured to be attached to a connector or a joint pipe element.

The joint pipe elements and/or connectors discussed above may be used for other well related purposes. For example, it is possible to manufacture a dip tube production unit with the concentric dual end of the joint pipe elements so that the dip tube production unit can be attached directly to the tubing systems discussed above. More specifically, FIG. 28 shows a tubing system 220 or 1020 that is connected at a location 2810 with a dip tube production unit 2800. The dip tube production unit 2800 has an inner pipe 2830 and an outer pipe 2840, and an upstream end 2800A of the dip tube production unit is identical to the upstream end of any of the joint pipe elements discussed above. Thus, the dip tube production unit 2800 can be connected to any joint pipe element, either directly if the joint pipe element 322 is used, or indirectly, through the connector 1026, if the joint pipe element 1022 is used.

In the embodiment illustrated in FIG. 28, gas is pumped from the surface along annulus B, as illustrated by the arrows. The gas moves the oil 210, present at the toe of the well, into annulus A and then all the way to the head of the well. In one embodiment, an optional one-way valve 2810 may be attached to the inner pipe 2830 of the dip tube production unit 2800 to prevent the oil from exiting annulus A, back into the well. In one application, any of the well servicing tools discussed above may be attached to the inner pipe 2830 of the dip tube production unit 2800, or they may be interconnected between joint pipe elements, above the dip tube production unit 2800. In one application, a packer 2802 may be placed between the casing 202 and the outer pipe of the joint pipe element to prevent the oil to move in annulus C, below the packer. However, the gas may be pumped down from the head of the well along annulus B, or annulus C or both.

Figure 29:
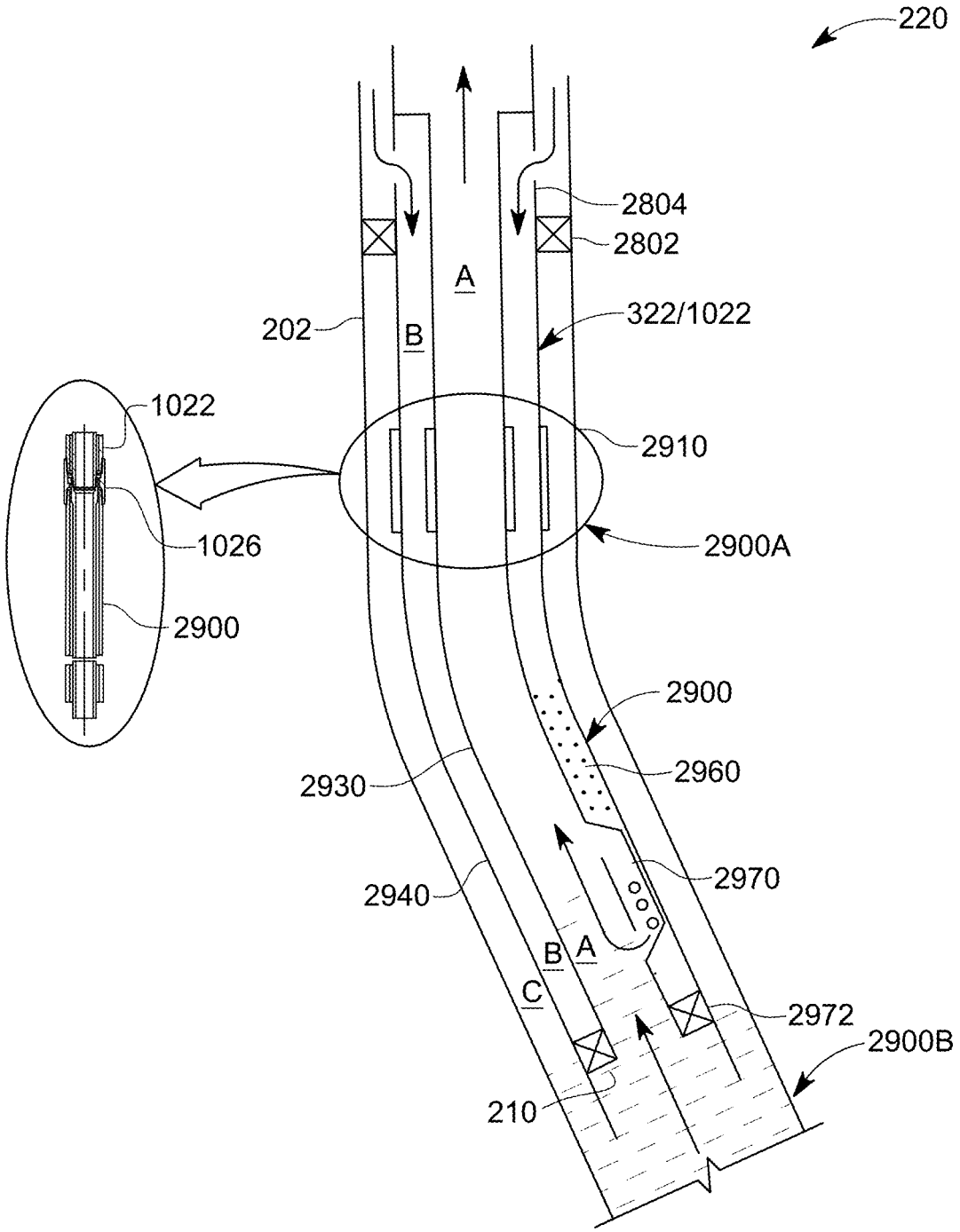
FIG. 29 shows a gas lift production tool configured to be attached to a connector or a joint pipe element.

FIG. 29 shows another embodiment of a tubing system 220 or 1020 in which a gas lift production unit 2900 is configured to have its upstream end 2900A configured to be able to directly connect to joint pipe element 322, or indirectly connect, through connector 1026, to joint pipe element 1022, at region 2910. The gas lift production unit 2900 has an inner pipe 2930 and an outer pipe 2940, that are partially concentric. However, because a gas valve 2970 is placed inside, the inner and outer pipes are not concentric at this location. A packer 2972 is placed between the inner and outer pipes, at the downstream end 2900B, so that the oil 210 can flow only inside the annulus A, but not annulus B The annulus B is used to receive the pressured gas from the head of the well. Initially, the pressured gas travels along annulus C, until reaching packer 2802, at which time the gas is transferred through slots 2804, formed into the outer pipe of the joint pipe element 322 or 1022, into annulus B. The gas 2960 then travels along annulus B in the gas lift production unit 2900, passes the gas valve 2970 into annulus A, and reduces the hydrostatic pressure above the oil 210, so that the oil 210 is moving toward the head of the well. Note that the gas valve 2970 allows the gas 2960 to pass from annulus B into the annulus A, but does not allow the oil 210 to pass from annulus A into annulus B.

In one application, any of the well servicing tools discussed with regard to FIGS. 21-27 may be combined with the dip tube production unit 2800 or the gas lift production unit 2900. In this case, each of the well servicing tool, the dip tube production unit 2800, and the gas lift production unit 2900 has at least one end configured to have dual concentric pipes, that can be connected to the discussed joint pipe elements or connectors by a single rotational motion.

Figure 30:
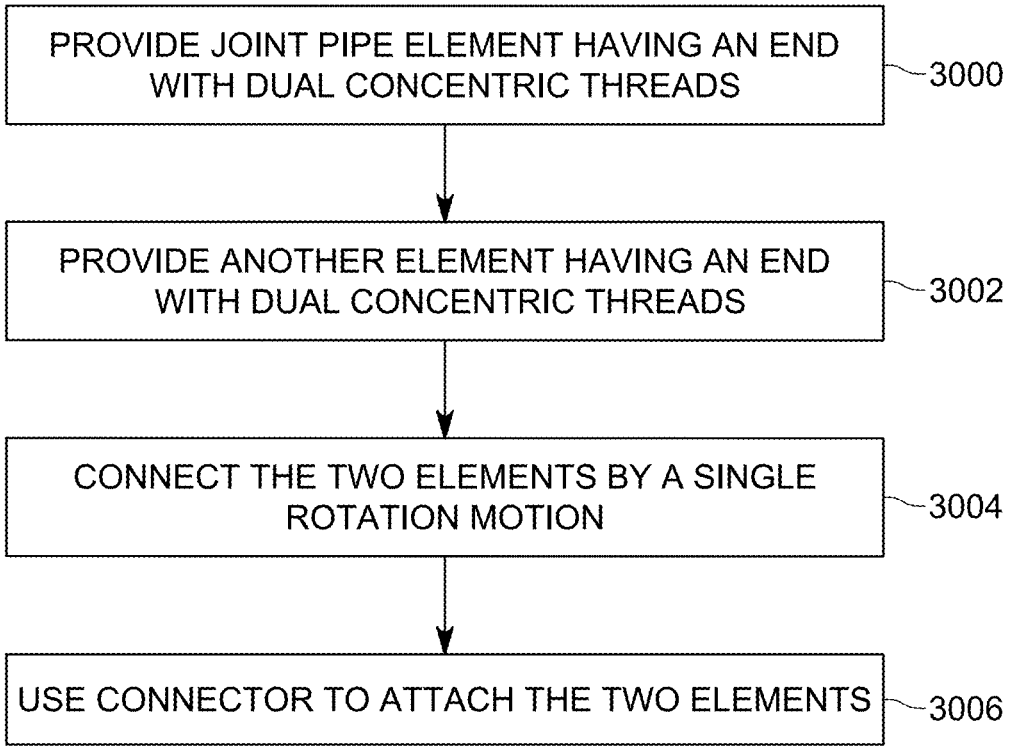
FIG. 30 is a flowchart of a method for assembling a joint pipe element.

A method for connecting a joint pipe element to another joint pipe element, or a well servicing tool, or a dip tube production unit, or a gas lift production unit, is illustrated in FIG. 30, and includes a step 3000 of providing a joint pipe element that has at least one end that includes at least an inner pipe and an outer pipe, each pipe having a threaded end, a step 3002 of providing another joint pipe element, or a well servicing tool, or a dip tube production unit, or a gas lift production unit, each of these elements having at least one end that includes an inner pipe and an outer pipe, and each pipe having a threaded end, and a step 3004 of attaching the at least one end of the pipe joint element to the at least one end of the another joint pipe element, or a well servicing tool, or a dip tube production unit, or a gas lift production unit, by a single rotational motion. The single rotational motion simultaneously engages the corresponding inner pipes and the corresponding outer pipes to form first and second tubular strings that are autonomous from a pressure point of view. According to another step, a connector may be used to join the ends of the joint pipe element and another joint pipe element, or a well servicing tool, or a dip tube production unit, or a gas lift production unit.

In one application, the A and/or B annulus of the inner and outer pipes of the joint pipe element may be coated to minimize frictional issues during flow conditions as well as during the initial deployment or subsequent recovery of a given string. In still another application, chemical treatments can be applied throughout the entire wellbore on all exposed surfaces for the casing, inner tubular string, and/or outer tubular string, by either batch or continuous treating methods for corrosion, scale or paraffin/asphaltene inhibition. As an example, a batch treatment could be pumped down the casing and recovered through the inner and outer strings. Continuous treatments could be pumped with the gas lift down the outer string and recovered up through the inner string. Other combinations are possible as well. The treatment system can be incorporated into the surface components of the system 220 or 1020. Circulation is possible between any of the annulus volumes in order to clean or stimulate the well, with or without chemicals.

Figure 31:
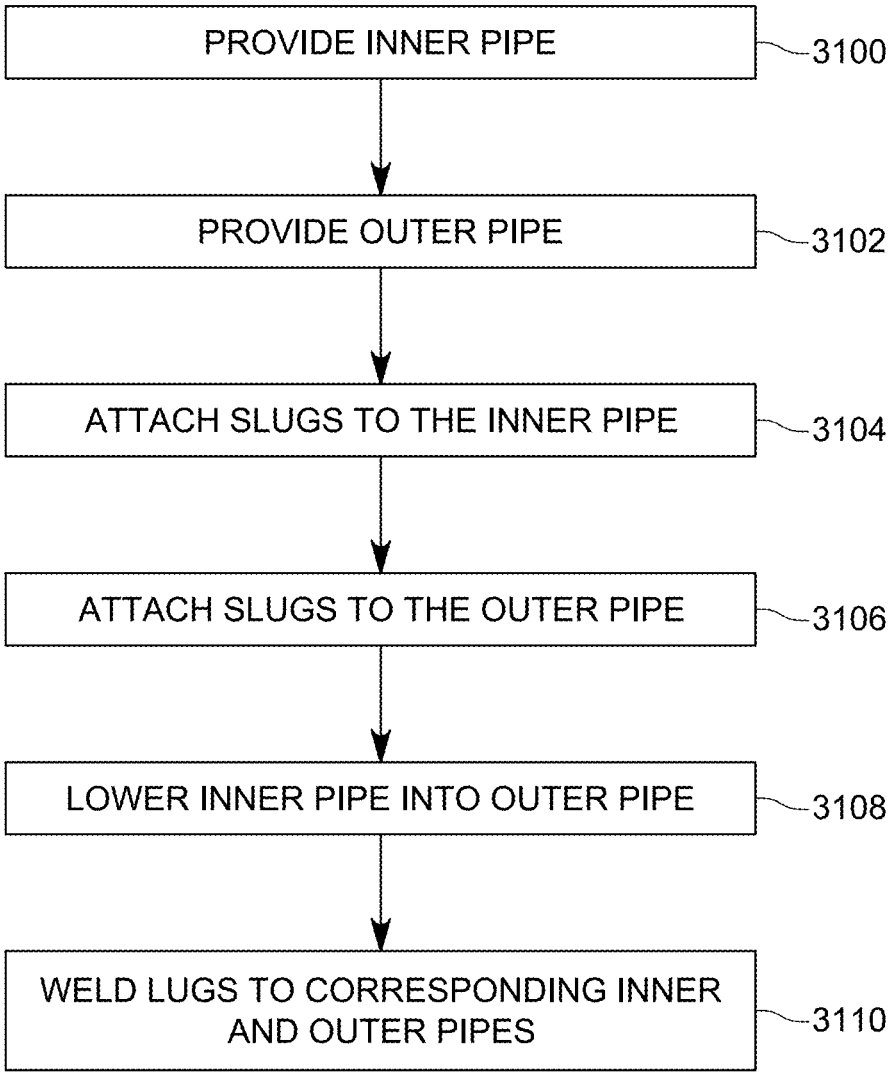
FIG. 31 is a flowchart of another method for assembling a joint pipe element.

A method for assembling the joint pipe element 322 shown in FIG. 3 is now discussed with regard to FIG. 31. The method includes a step 3100 of providing the inner pipe 330 and a step 3102 of providing the outer pipe 340. The inner and outer pipes have corresponding tubular pins and/or boxes that were previously manufactured by known methods, for example upsetting. Also, the end of the inner and outer pipes have been threaded as illustrated in FIG. 3 (or any other figure) and optionally an additional seal has been placed in those ends. One or more upstream lugs 360 (preferably 3) are attached in step 3104 to an outer surface of the inner pipe 330. The upstream lugs may be welded or attached by any another means. In step 3106, the downstream lugs 370 are attached to the interior surface of the outer pipe 340, for example, by welding. In step 3108, the inner pipe 330 together with the upstream lugs 360 are lowered into the outer pipe 340 until the upstream lugs 360 touch the corresponding shoulders 350. The inner pipe presses the downstream lugs while the outer pipe presses the upstream lugs so that the single joint pipe element is formed. In optional step 3110, the downstream lugs 370 are welded to the inner pipe 330 and the upstream lugs 360 are welded to the outer pipe 340.

Note that the obtained joint pipe element is advantageous for its efficiency and simplicity in use. Previously, the operator of the well had to lower one by one, each of the outer pipes and to connect each of them to the previous one to form the outer tubular string. Then, the operator of the well had to lower one by one, each of the inner pipes and to connect each of them to the previous one to form the inner tubular string. The inner tubular string had to be lowered inside the outer tubular string, which added more complications as the inner tubular string contacts the outer tubular string during this operation. A large friction force between the outer tubular string and the inner tubular string had to be overcome, especially for long and horizontal wells.

In contrast to this painstakingly slow method, the operator of the well, when supplied with the novel joint pipe elements discussed above, connects at the same time, the inner pipes to the outer pipes, and in addition, there is no need to push the inner tubular string relative to the outer tubular string as the two strings are generated at the same time, with a single rotational movement of one joint pipe element to another joint pipe element. The operator of this tubing system is free of all the problems associated with pushing the inner tubular string into the outer tubular string in a long and/or horizontal well. Further the number of operations for attaching the inner and outer pipes to each other is reduced by half with the novel joint pipe element, which means time and money saved in operating the well.

Figure 32:
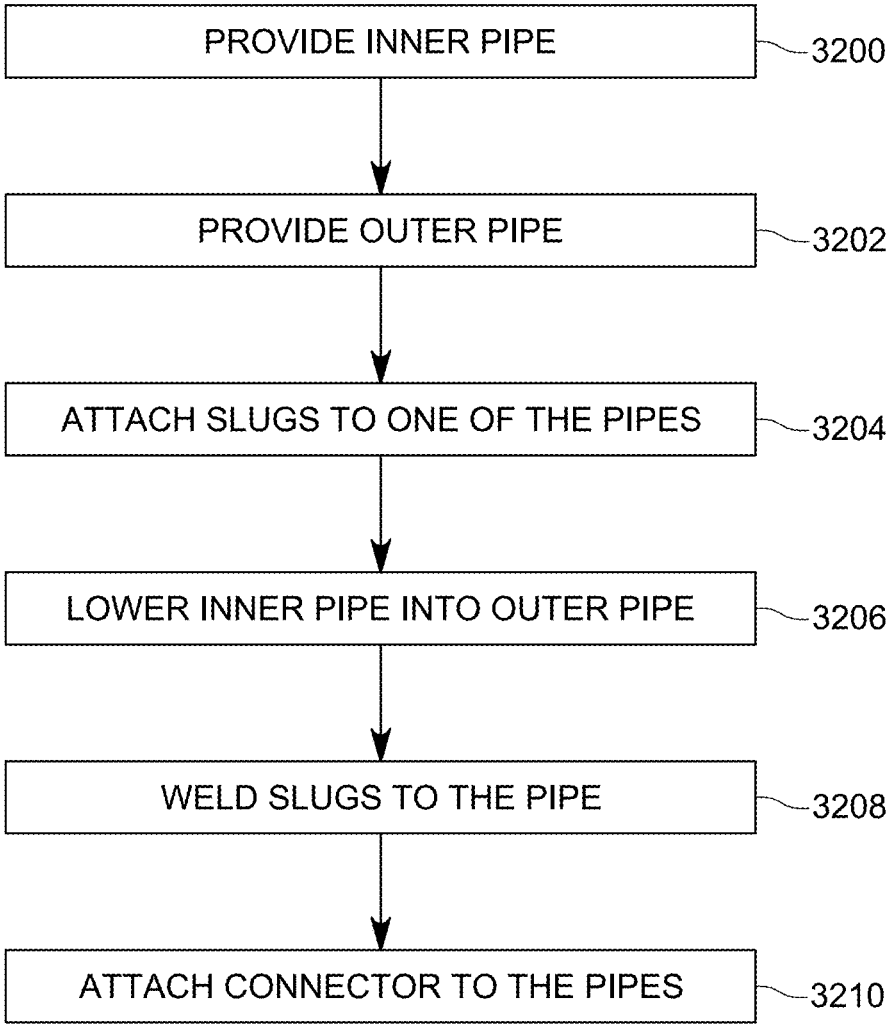
FIG. 32 is a flowchart of a method for assembling a joint pipe element and adding a double-housed connector.

A method for assembling the joint pipe element 1022 shown in FIG. 11 is now discussed with regard to FIG. 32. In step 3200 the inner pipe 330 is provided. The inner pipe is already processed to have a box at one end and a pin at another end. Variations of this arrangement may be implemented base on the exact shape of the connector 1026. In step 3202 the outer pipe 340 is provided. The outer pipe is already processed to have a pin at each end. However, it is also possible to have a box or two boxes, depending the configuration of the connector 1026. Threads are formed for each pipe, either inside the box or outside the pin. For the embodiment shown in FIG. 11, the inner pipe 330 has one upstream tubular box 332 and one tubular pin 336 with corresponding threads. The outer pipe 340 has tubular pins at both ends with corresponding threads. In step 3204, the downstream lugs 370 are attached to an inner surface of the outer pipe and optionally, the upstream lugs 360 (if used) are attached to the inner surface of the outer pipe. Then, in step 3206 the inner pipe is lowered into the outer pipe and the lugs are pressed between the two pipes. In optional step 3208, the lugs (both upstream and downstream) are welded to the other pipe for establishing the joint pipe element. In step 3210, the connector 1026 is attached to one end of the joint pipe element 1022 by screwing either the outer or the inner pipe to a corresponding thread of the connector, and also by pressing other lugs 1060 between the connector and the pipe that was not screwed, as illustrated in FIG. 12.

Figure 33:
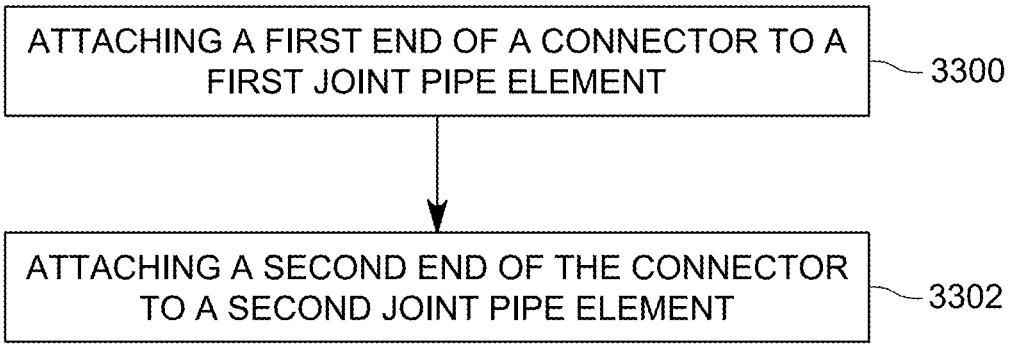
FIG. 33 is a flowchart of a method for attaching two joint pipe elements to a connector.

A method for forming an artificial lift system 1020 for a well is now discussed with regard to FIG. 33. The method includes a step 3300 of attaching a first end of a connector 1026 to a first joint pipe element 1022, where the first joint pipe element 1022 has an inner pipe 330 and an outer pipe 340, the inner pipe 330 being fixedly attached to an inside of the outer pipe 340, and a step 3302 of attaching a second end of the connector 1026 to a second joint pipe element 1522, where the second joint pipe element 1522 has an inner pipe 530 and an outer pipe 540, the inner pipe 530 being fixedly attached to an inside of the outer pipe 540. The first joint pipe element 1022 and the second joint pipe element 1522 form an outer tubular string 1004 and an inner tubular string 1002.

In one application, the method further includes pumping a gas through one of the inner and the outer tubular strings, and receiving oil through another of the inner and the outer tubular strings.

Figure 34:
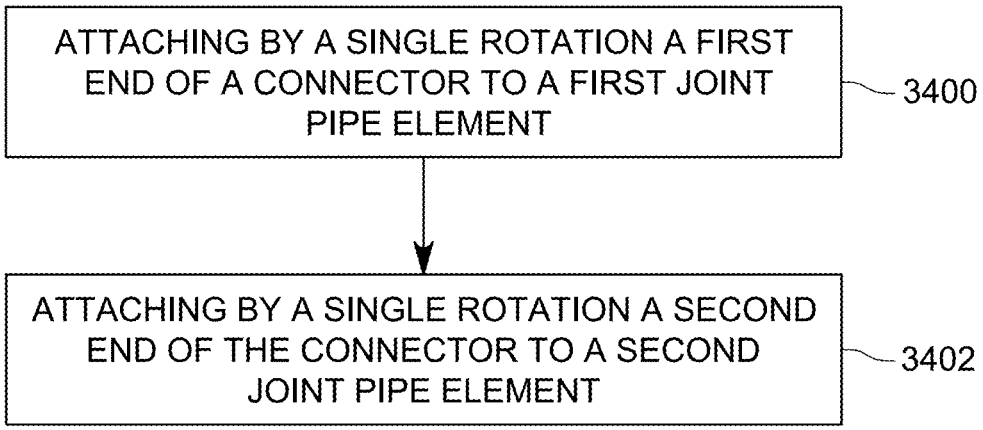
FIG. 34 is a flowchart of another method for attaching two joint pipe elements to a connector.

Another method for forming an artificial lift system 1020 for a well is now discussed with regard to FIG. 34. The method includes a step 3400 of attaching, by a single rotational motion, a first end of a connector 1727 to a first joint pipe element 1722, and a step 3402 of attaching, by a single rotational motion, a second end of the connector 1727 to a second joint pipe element 2122. The connector 1727, the first joint pipe element 1722, and the second joint pipe element 2122 form an inner tubular string 1002 and an outer tubular string 1004 that provide independent flow paths.

Figure 35:
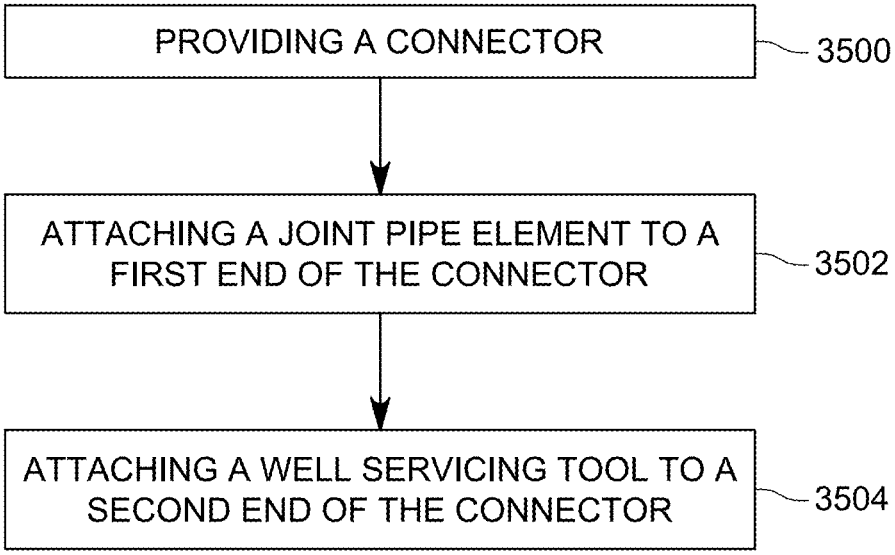
FIG. 35 is a flowchart of a method for attaching a joint pipe element to a well servicing tool using a double housed connector.

According to still another embodiment, as illustrated in FIG. 35, there is a method of forming inner and outer tubular strings for a well. The method includes a step 3500 of providing a connector 1727 that has a bore and annulus, a step 3502 of attaching a joint pipe element 1722 to a first end of the connector 1727 with a single rotational motion; and a step 3504 of attaching a well servicing tool 2222 to a second end of the connector 1727, with a single rotational motion. The connector 1727, the joint pipe element 1722, and an upstream part of the well servicing tool 2222 form the inner tubular string 1002 and the outer tubular string 1004, which provide independent flow paths.

Figure 36:
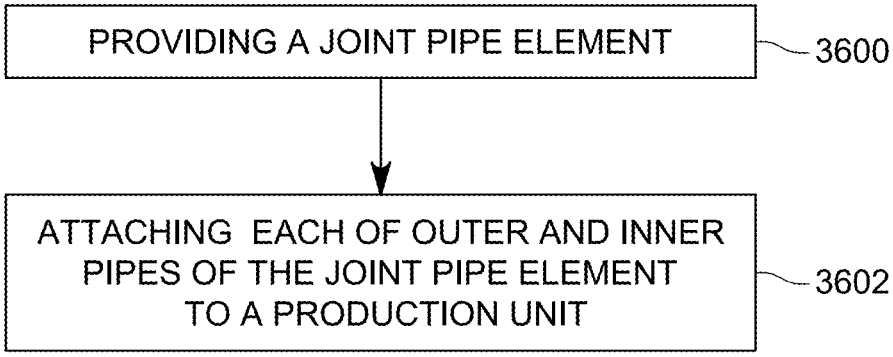
FIG. 36 is a flowchart of a method for attaching a joint pipe element to a production unit using a double housed connector.

According to yet another method, as illustrated in FIG. 36, there is a method for connecting a joint tube element to a production unit for extracting oil from a well. The method includes a step 3600 of providing a joint pipe element 322 having concentric outer and inner pipes, and a step 3602 of attaching each of the outer and inner pipes of the joint pipe element 322 to a production unit 2800, 2900, by a single rotational motion. The joint pipe element 322 and an upstream part of the production unit 2800, 2900 form an inner tubular string 1002 and an outer tubular string 1004 that provide independent flow paths.

In one application, the method further comprises a step of threading corresponding inner and outer pipes of the production unit, which include concentric ends, to the concentric inner and outer pipes of the joint pipe element, and/or a step of forming, with the inner pipe 330 of the joint pipe element 322 and the inner pipe 2830 of the production unit, the inner tubular string, and/or a step of forming, with the outer pipe 340 of the joint pipe element 322 and the outer pipe 2840 of the production unit, the outer tubular string. In one application, an upstream end of the outer pipe and an upstream end of the inner pipe have threads having a same number of teeth per unit length. The method may also include a step of placing plural lugs between the inner pipe and the outer pipe of the joint pipe element to make the upstream ends concentric. In one application, the plural lugs prevent one of the inner pipe and the outer pipe to independently rotate relative to another of the inner pipe and the outer pipe of the joint pipe element. In another application, a downstream end of the outer pipe and a downstream end of the inner pipe of the joint pipe element have threads having a same number of teeth per unit length as the upstream ends. The method may also include a step of attaching a connector 1026 between the joint pipe element and the production unit, the connector having a first end that connects to the joint pipe element and a second end that connects to the production unit.

Various implementations of the novel concepts discussed herein are now presented in embodiments A to D.

Embodiment A

1. A connector (1026) for attaching joint pipe elements for forming an artificial lift system for a well, the connector including:

a body (1027) having a bore (1028) that extends along a longitudinal axis;

an upstream part (1026A) having internal threads (1038);

a downstream part (1026B) having internal threads (1044); and a shoulder (1050) formed inside the bore (1028), wherein the upstream part (1026A) is configured to engage with an inner pipe or an outer pipe of a first joint pipe element (1522), and the downstream part (1026B) is configured to engage with an inner pipe or an outer pipe of a second joint pipe element (1022), so that an inner and an outer tubular string are formed. The connector may be implemented with the following variations:

2. A number of teeth per unit length for the upstream part, the inner pipe and the outer pipe of the first joint pipe element, the downstream part, and the inner and the outer pipe of the second joint pipe element, is the same.

3. The outer pipe and the inner pipe of the second joint pipe element simultaneously engage the connector and the inner pipe of the first joint pipe element, respectively, by a single rotational motion.

4. The outer pipe and the inner pipe of the second joint pipe element simultaneously engage the outer pipe of the first joint pipe element and the connector, respectively, by a single rotational motion.

5. An artificial lift system (1020) for a well, the system including:

a connector (1026) having a bore (1028) that extends along a longitudinal axis;

a first joint pipe element (1022) having an inner pipe (330) and an outer pipe (340), the inner pipe (330) being fixedly attached to an inside of the outer pipe (340); and a second joint pipe element (1522) having an inner pipe (530) and an outer pipe (540), the inner pipe (530) being fixedly attached to an inside of the outer pipe (540), wherein the first joint pipe element (1022) and the second joint pipe element (1522) are configured to attach to opposite ends of the connector (1026) to form an outer tubular string (1004) and an inner tubular string (1002). The system may be implemented with the following variations:

6. The connector and the first and second joint pipe elements are configured so that a pressure in the inner tubular string is independent of a pressure in the outer tubular string.

7. The outer pipe (340) of the first joint element (1022) is engaged by threads to a first end of the connector (1026).

8. The outer pipe (540) of the second joint element (1522) is engaged by threads to a second end of the connector (1026).

9. The inner pipe (330) of the first joint element (1022) is directly engaged by threads to the inner pipe (530) of the second joint element (1522).

10. The inner pipe (330) of the first joint element (1022) is engaged by threads to a first end of the connector (1026).

11. The inner pipe (530) of the second joint element (1522) is engaged by threads to a second end of the connector (1026).

12. The outer pipe (340) of the first joint element (1022) is directly engaged by threads to the outer pipe (540) of the second joint element (1522).

13. The connector (1026) may include:

a body (1027) having a bore (1028) that extends along a longitudinal axis;

an upstream part (1026A) having internal threads (1038);

a downstream part (1026B) having internal threads (1044); and a shoulder (1050) formed inside the bore (1028).

14. A number of teeth per unit length for an upstream part of the connector, a downstream part of the connector, the inner pipe and the outer pipe of the first joint pipe element, and the inner pipe and the outer pipe of the second joint pipe element is the same.

15. The outer pipe and the inner pipe of the second joint pipe element simultaneously engage the connector and the inner pipe of the first joint pipe element, respectively, by a single rotational motion.

16. The outer pipe and the inner pipe of the second joint pipe element simultaneously engage the outer pipe of the first joint pipe element and the connector, respectively, by a single rotational motion.

17. The inner pipe and the outer pipe of the first joint pipe element are concentric.

18. The inner pipe and the outer pipe of the second joint pipe element are concentric.

19. A method for forming an artificial lift system (1020) for a well includes:

attaching (3300) a first end of a connector (1026) to a first joint pipe element (1022), wherein the first joint pipe element (1022) has an inner pipe (330) and an outer pipe (340), the inner pipe (330) being fixedly attached to an inside of the outer pipe (340); and attaching (3302) a second end of the connector (1026) to a second joint pipe element (1522), wherein the second joint pipe element (1522) has an inner pipe (530) and an outer pipe (540), the inner pipe (530) being fixedly attached to an inside of the outer pipe (540), wherein the first joint pipe element (1022), the connector (1026), and the second joint pipe element (1522) form an outer tubular string (1004) and an inner tubular string (1002).

20. The method may further include:

pumping a gas through one of the inner and the outer tubular strings; and receiving oil through another of the inner and the outer tubular strings.

Embodiment B

1. A connector (1726) for attaching joint pipe elements for forming an artificial lift system for a well, the connector including:

an outer body (1727A) having a bore (1731);

an inner body (1727B) fixedly attached to an inside of the bore (1731); and a bridge (1728) that physically connects the outer body (1727A) to the inner body (1727B), wherein each end of the outer body and the inner body has a corresponding thread. The connector may be implemented with the following variations:

2. The outer body has an upstream end (1810) having internal threads (1812), and a downstream end (1820) having internal threads (1820).

3. The inner body has an upstream end (1830) having internal threads (1832), and a downstream end (1840) having internal threads (1842).

4. The bridge has through holes that allow a fluid to move through an annulus formed between the inner body and the outer body.

5. The holes are round.

6. The holes are elongated.

7. The inner body has a bore that is independent of the annulus.

8. The upstream end (1810) of the outer body is configured to engage with an outer pipe of a first joint pipe element (1722), and the upstream end (1830) of the inner body is configured to engage with an inner pipe of the first joint pipe element, simultaneously with the outer pipe.

9. The downstream end (1820) of the outer body is configured to engage with an outer pipe of a second joint pipe element, and the downstream end (1840) of the inner body is configured to engage with an inner pipe of the second joint pipe element, simultaneously with the outer pipe.

10. The inner body, the outer body, and the bridge are formed integrally as a single piece.

11. The bridge prevents the inner body to rotate relative to the outer body.

12. A system (1020) for attaching joint pipe elements for forming an artificial lift system for a well, the system including:

a connector (1727) having a bore and an annulus;

a first joint pipe element (1722) configured to be attached to a first end of the connector (1727) with a single rotational motion; and a second joint pipe element (2122) configured to be attached to a second end of the connector (1727) with another single rotational motion, wherein the connector (1727), the first joint pipe element (1722), and the second joint pipe element (2122) form an inner tubular string (1002) and an outer tubular string (1004) that provide independent flow paths. The system may be implemented with the following variations:

13. An inner pipe (330) of the first joint pipe element (1722), the bore of the connector (1727), and an inner pipe (2130) of the second joint element (2122) form the inner tubular string.

14. An outer pipe (340) of the first joint pipe element (1722), the annulus of the connector (1727), and an outer pipe (2140) of the second joint element (2122) form the outer tubular string.

15. The connector includes:

an outer body (1727A) having a bore;

an inner body (1727B) fixedly attached to an inside of the bore; and a bridge (1728) that physically connects the outer body (1727A) to the inner body (1727B), wherein each end of the outer body and the inner body has a corresponding thread.

16. The outer body has an upstream end (1810) having internal threads (1812), and a downstream end (1820) having internal threads (1820), and the inner body has an upstream end (1830) having internal threads (1832), and a downstream end (1840) having internal threads (1842).

17. The bridge has through holes that allow a fluid to move through the annulus formed between the inner body and the outer body.

18. The upstream end (1810) of the outer body is configured to engage with an outer pipe of the first joint pipe element (1722), and the upstream end (1830) of the inner body is configured to engage with an inner pipe of the first joint pipe element, simultaneously with the outer pipe.

19. The downstream end (1820) of the outer body is configured to engage with an outer pipe of the second joint pipe element, and the downstream end (1840) of the inner body is configured to engage with an inner pipe of the second joint pipe element, simultaneously with the outer pipe.

20. The inner body, the outer body, and the bridge are formed integrally as a single piece.

21. A method for forming an artificial lift system (1020) for a well includes:

attaching (3400) by a single rotational motion, a first end of a connector (1727) to a first joint pipe element (1722); and attaching (3400) by another single rotational motion, a second end of the connector (1727) to a second joint pipe element (2122), wherein the connector (1727), the first joint pipe element (1722), and the second joint pipe element (2122) form an inner tubular string (1002) and an outer tubular string (1004) that provide independent flow paths.

Embodiment C

1. A well servicing tool (2222, 2422, 2522, 2622, 2722) for moving oil through a well, the tool including:

an outer pipe (2240) having a bore;

an inner pipe (2230) extending inside the bore of the outer pipe (2240); and an oil extracting instrument (2000) configured to be in fluid communication with the inner pipe (2230), wherein the inner pipe is fixedly attached to the outer pipe so that a torque applied to the outer pipe simultaneously rotates the outer pipe and the inner pipe. The tool may be implemented with the following variations:

2. An upstream end of the outer pipe and an upstream end of the inner pipe have threads having a same number of teeth per unit length.

3. The upstream end of the outer pipe is concentric to the upstream end of the inner pipe.

4. The tool may further include:

plural lugs located between the inner pipe and the outer pipe to make the upstream ends concentric.

5. The plural lugs prevent one of the inner pipe and the outer pipe to independently rotate relative to another of the inner pipe and the outer pipe.

6. A downstream end of the outer pipe and a downstream end of the inner pipe have threads having a same number of teeth per unit length as the upstream ends.

7. The downstream end of the outer pipe is concentric to the downstream end of the inner pipe.

8. A downstream end of the outer pipe and a downstream end of the inner pipe have no threads.

9. The oil extracting instrument is a sleeve placed inside a bore of the inner pipe to cover a port between the bore and an annulus formed between the inner pipe and the outer pipe.

10. The sleeve is configured to slide to open and close the port.

11. The oil extracting instrument is a gas lift device that includes a gas valve.

12. The oil extracting instrument is a hydraulic pump.

13. The oil extracting instrument is a pump.

14. The oil extracting instrument is an electric submersible pump.

15. A system (1020) for attaching a joint pipe element to a well servicing tool for forming an artificial lift system for a well, the system including:

a connector (1727) having a bore and an annulus;

the joint pipe element (1722) configured to be attached to a first end of the connector (1727) with a single rotational motion; and the well servicing tool (2222) configured to be attached to a second end of the connector (1727) with a single rotational motion, wherein the connector (1727), the joint pipe element (1722), and an upstream part of the well servicing tool (2222) form an inner tubular string (1002) and an outer tubular string (1004) that provide independent flow paths. The system may be implemented with the following variations:

16. An inner pipe (330) of the joint pipe element (1722), the bore of the connector (1727), and an inner pipe (2230) of the well servicing tool (2222) form the inner tubular string.

17. An outer pipe (340) of the joint pipe element (1722), the annulus of the connector (1727), and an outer pipe (2240) of the well servicing tool (2222) form the outer tubular string.

18. The well servicing tool includes a pump.

19. One of the inner and outer tubular strings is used to pump gas to the well servicing tool and another one of the inner and outer tubular strings is used to extract oil from the well.

20. A system (1020) for attaching a joint pipe element to a well servicing tool for forming an artificial lift system for a well, the system including:

the joint pipe element (1722); and the well servicing tool (2222) configured to be attached directly to an end of the joint pipe element (1722) with a single rotational motion, wherein the joint pipe element (1722) and an upstream part of the well servicing tool (2222) form an inner tubular string (1002) and an outer tubular string (1004) that provide independent flow paths. The system may be implemented with the following variations:

21. The joint pipe element includes concentric inner and outer pipes and the well servicing tool includes corresponding inner and outer pipes that have concentric ends configured to thread to the concentric inner and outer pipes of the joint pipe element.

22. A method of forming inner and outer tubular strings for a well, the method including:

providing (3500) a connector (1727) that has a bore and an annulus;

attaching (3502) a joint pipe element (1722) to a first end of the connector (1727) with a single rotational motion; and attaching (3504) a well servicing tool (2222) to a second end of the connector (1727) with a single rotational motion, wherein the connector (1727), the joint pipe element (1722), and an upstream part of the well servicing tool (2222) form the inner tubular string (1002) and the outer tubular string (1004), which provide independent flow paths.

Embodiment D

1. A tubing system (220) configured to lift oil from a well, the tubing system including:

a joint pipe element (322) having concentric outer and inner pipes; and a production unit (2800, 2900) attached to the outer and inner pipes of the joint pipe element by a single rotational motion, wherein the joint pipe element (322) and an upstream part of the production unit (2800, 2900) form an inner tubular string (1002) and an outer tubular string (1004) that provide independent flow paths. The tubing system may be implemented with the following variations:

2. The production unit includes corresponding inner and outer pipes that have concentric ends configured to attach by threads to the concentric inner and outer pipes of the joint pipe element.

3. The inner pipe (330) of the joint pipe element (322) and the inner pipe (2830) of the production unit form the inner tubular string.

4. The outer pipe (340) of the joint pipe element (322) and the outer pipe (2840) of the production unit form the outer tubular string.

5. The system may further include:

a connector (1026) having a first end that connects to the joint pipe element and a second end that connects to the production unit.

6. An upstream end of the outer pipe and an upstream end of the inner pipe of the joint pipe element have threads having a same number of teeth per unit length.

7. The system may further include: plural lugs located between the inner pipe and the outer pipe of the joint pipe element to make the upstream ends concentric.

8. The plural lugs prevent one of the inner pipe and the outer pipe to independently rotate relative to another of the inner pipe and the outer pipe of the joint pipe element.

9. A downstream end of the outer pipe and a downstream end of the inner pipe of the joint pipe element have threads having a same number of teeth per unit length as the upstream ends.

10. The connector may include:

an outer body (1727A) having a bore;

an inner body (1727B) fixedly attached to an inside of the bore; and a bridge (1728) that physically connects the outer body (1727A) to the inner body (1727B), wherein each end of the outer body and the inner body has a corresponding thread.

11. The bridge has through holes that allow a fluid to move through an annulus formed between the inner body and the outer body.

12. The outer body has an upstream end (1810) having internal threads (1812), and a downstream end (1820) having internal threads (1820), and the inner body has an upstream end (1830) having internal threads (1832), and a downstream end (1840) having internal threads (1842).

13. The upstream end (1810) of the outer body is configured to engage with the outer pipe of the first joint pipe element (322), and the upstream end (1830) of the inner body is configured to engage with the inner pipe of the first joint pipe element, simultaneously with the outer pipe.

14. The downstream end (1820) of the outer body is configured to engage with an outer pipe of the production unit, and the downstream end (1840) of the inner body is configured to engage with an inner pipe of the production unit, simultaneously with the outer pipe.

15. The inner body, the outer body, and the bridge are formed integrally as a single piece.

16. The production unit is a dip tube production unit.

17. The production unit is a gas lift production unit.

18. The gas lift production unit has a gas valve located in a wall of an inner tube, and the gas valve is configured to allow gas from the outer tubular string to enter the inner tubular string.

19. A method for connecting a joint tube element to a production unit for extracting oil from a well includes:

providing (3600) a joint pipe element (322) having concentric outer and inner pipes; and attaching (3602) each of the outer and inner pipes of the joint pipe element (322) to a production unit (2800, 2900) by a single rotational motion, wherein the joint pipe element (322) and an upstream part of the production unit (2800, 2900) form an inner tubular string (1002) and an outer tubular string (1004) that provide independent flow paths.

20. The method may further include:

threading corresponding inner and outer pipes of the production unit, which include concentric ends, to the concentric inner and outer pipes of the joint pipe element.

21. The method may further include:

forming with the inner pipe (330) of the joint pipe element (322) and the inner pipe (2830) of the production unit the inner tubular string.

22. The method may further include:

forming with the outer pipe (340) of the joint pipe element (322) and the outer pipe (2840) of the production unit the outer tubular string.

23. A downstream end of the outer pipe and a downstream end of the inner pipe of the joint pipe element have threads having a same number of teeth per unit length.

24. The method may further include:

placing plural lugs between the inner pipe and the outer pipe of the joint pipe element to make the pipes concentric.

25. The plural lugs prevent one of the inner pipe and the outer pipe to independently rotate relative to another of the inner pipe and the outer pipe of the joint pipe element.

26. An upstream end of the outer pipe and an upstream end of the inner pipe of the joint pipe element have threads having a same number of teeth per unit length as the downstream ends.

27. The method may further include:

attaching a connector (1026) between the joint pipe element and the production unit, the connector having a first end that connects to the joint pipe element and a second end that connects to the production unit.

The disclosed embodiments provide methods and systems for artificially lifting a formation fluid from a well when the natural pressure of the formation fluid is not enough to bring the formation fluid to the surface. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A tubing system for transporting a fluid in a well, the tubing system comprising:

a first joint pipe element comprising:

a first outer pipe having first external threads at a first end; and a first inner pipe having second external threads at a first end, the first inner pipe being located inside the first outer pipe;

a second joint pipe element comprising:

a second outer pipe having third external threads at a first end; and a second inner pipe having fourth external threads at a first end, the second inner pipe being located inside the second outer pipe; and a connector comprising:

an outer body comprising a first box end with first inner threads configured to engage the first external threads of the first outer pipe and a third box end with third inner threads configured to engage the third external threads of the second outer pipe; and an inner body attached to the outer body and comprising a second box end with second inner threads configured to engage the second external threads of the first inner pipe and a fourth box end with fourth inner threads configured to engage the fourth external threads of the second inner pipe;

wherein the inner body is attached to the outer body such that an annular space is disposed between the inner body and the outer body and a continuous flow path extends through said annular space.

2. The tubing system of claim 1, wherein the inner and outer pipes are concentric.

3. The tubing system of claim 1, wherein the first external threads and second external threads have the same number of teeth per unit length.

4. The tubing system of claim 1, further comprising a bridge attaching the inner body to the outer body.

5. The tubing system of claim 4, wherein the bridge comprises holes that create the continuous flow path.

6. The tubing system of claim 1, wherein the second box end is axially offset from the first box end.

7. The tubing system of claim 1, wherein the third external threads and fourth external threads have the same number of teeth per unit length.

8. The tubing system of claim 1, wherein the fourth box end is axially offset from the third box end.

9. The tubing system of claim 1, further comprising a plurality of lugs located between the outer pipe and the inner pipe.

10. The tubing system of claim 9, wherein at least one of the plurality of lugs is welded to the outer pipe or the inner pipe.

11. The tubing system of claim 9, wherein at least one of the plurality of lugs is welded to the outer pipe and the inner pipe.

12. The tubing system of claim 9, wherein the outer pipe further comprises a shoulder configured to receive at least one lug of the plurality of lugs.

* * * * *